US012565742B2

(12) United States Patent
Wang et al.

(10) Patent No.: US 12,565,742 B2
(45) Date of Patent: Mar. 3, 2026

(54) PAVER CONTROL SYSTEM, PAVER CONTROL METHOD, AND PAVER

(71) Applicant: Hunan Sany Zhongyi Machinery Co., Ltd., Yiyang (CN)

(72) Inventors: Li Wang, Yiyang (CN); Zhiguo Ren, Yiyang (CN); Haibo Wang, Yiyang (CN)

(73) Assignee: Hunan Sany Zhongyi Machinery Co., Ltd., Yiyang (CN)

( * ) Notice: Subject to any disclaimer, the term of this patent is extended or adjusted under 35 U.S.C. 154(b) by 876 days.

(21) Appl. No.: 17/877,904

(22) Filed: Jul. 30, 2022

(65) Prior Publication Data

US 2022/0364317 A1 Nov. 17, 2022

Related U.S. Application Data

(63) Continuation of application No. PCT/CN2021/103612, filed on Jun. 30, 2021.

(30) Foreign Application Priority Data

Jul. 3, 2020 (CN) ..... 202010629813.2
Jul. 21, 2020 (CN) ..... 202010704343.1
Jul. 21, 2020 (CN) ..... 202010705767.X

(51) Int. Cl.
*E01C 19/48* (2006.01)
*E01C 23/01* (2006.01)

(52) U.S. Cl.
CPC ..... *E01C 19/48* (2013.01); *E01C 23/01* (2013.01); *E01C 2301/02* (2013.01)

(58) Field of Classification Search
CPC ..... E01C 19/48; E01C 23/01; E01C 2301/02
(Continued)

(56) References Cited

U.S. PATENT DOCUMENTS

2012/0065924 A1 3/2012 Nielsen et al.
2014/0133906 A1* 5/2014 Frelich ..... E01C 19/48 404/75

(Continued)

FOREIGN PATENT DOCUMENTS

CN 102116658 A 7/2011
CN 102653934 A 9/2012

(Continued)

OTHER PUBLICATIONS

First Examination Report issued in counterpart Indian Patent Application No. 202227043713, dated Mar. 13, 2023.

(Continued)

*Primary Examiner* — Raymond W Addie
(74) *Attorney, Agent, or Firm* — Westbridge IP LLC

(57) ABSTRACT

Disclosed are a paver control system, a paver control method and a paver. The paver control system includes: an image acquisition device provided on the paver for acquiring image information of an execution device of the paver; a controller provided on the paver and electrically connected with the image acquisition device and the execution device for controlling the execution device to operate according to the image information acquired by the image acquisition device; and the execution device is provided on the paver for operating under a control of the controller. The execution device includes at least one of a driving mechanism, a prompting device and a material distributing device.

20 Claims, 22 Drawing Sheets

(58) Field of Classification Search
USPC ..... 404/84.05, 118; 701/50
See application file for complete search history.

(56) References Cited

U.S. PATENT DOCUMENTS

| | | | | |
|---|---|---|---|---|
| 2015/0197900 | A1* | 7/2015 | Ichikawa | E01C 19/48 382/104 |
| 2016/0042235 | A1 | 2/2016 | Buschmann et al. | |
| 2016/0076228 | A1* | 3/2016 | Nau | E02F 3/842 701/50 |
| 2019/0283583 | A1* | 9/2019 | Buschmann | B60K 35/22 |

FOREIGN PATENT DOCUMENTS

| | | | | |
|---|---|---|---|---|
| CN | 104118351 | A | 10/2014 | |
| CN | 104532723 | A | 4/2015 | |
| CN | 105568825 | A | 5/2016 | |
| CN | 106483987 | A | 3/2017 | |
| CN | 106696090 | A | 5/2017 | |
| CN | 206219950 | U | 6/2017 | |
| CN | 107128661 | A | 9/2017 | |
| CN | 107761516 | A | 3/2018 | |
| CN | 108344670 | A | 7/2018 | |
| CN | 109082975 | A | 12/2018 | |
| CN | 109399254 | A | 3/2019 | |
| CN | 111032958 | A | 4/2020 | |
| CN | 111236017 | A | 6/2020 | |
| CN | 111254783 | A | 6/2020 | |
| CN | 111694312 | A | 9/2020 | |
| CN | 111749082 | A | 10/2020 | |
| CN | 111809481 | A | 10/2020 | |
| DE | 69411794 | T2 | 3/1999 | |
| DE | 102018208263 | A1 * | 11/2019 | F04B 15/02 |
| DE | 102018009666 | A1 * | 6/2020 | E01C 23/07 |
| EP | 0774542 | A1 | 5/1997 | |
| JP | 2019007307 | A | 1/2019 | |
| WO | WO-2019031318 | A1 * | 2/2019 | E01C 19/48 |

OTHER PUBLICATIONS

International Search Report issued in corresponding PCT Application No. PCT/CN2021/103612, dated Sep. 28, 2021.
Written Opinion issued in corresponding PCT Application No. PCT/CN2021/103612, dated Sep. 28, 2021.

* cited by examiner

PAVER CONTROL SYSTEM, PAVER CONTROL METHOD, AND PAVER

CROSS-REFERENCE TO RELATED APPLICATIONS

This application is a continuation of International Application No. PCT/CN2021/103612, filed on Jun. 30, 2021, which claims priority to Chinese Patent Applications No. 202010629813.2, filed on Jul. 3, 2020, Chinese Patent Applications No. 202010704343.1, filed on Jul. 21, 2020, and Chinese Patent Applications No. 202010705767.X, filed on Jul. 21, 2020. All of the aforementioned patent applications are hereby incorporated by reference in their entireties.

TECHNICAL FIELD

The present application relates to the field of paver, in particular to a paver control system, a paver control method and a paver.

BACKGROUND

A paver is a common road building machine, which is used to pave road surfaces. During an operating process of the paver, a hopper needs to cooperate with an unloading process of a feeding car, thus operation accuracy of the hopper is required to be high. In a present construction process, an operation for spreading and closing the hopper is mostly completed by manually visual measuring a position of the feeding car, so that accuracy and operation efficiency are low and operators need to be experienced. A labor intensity of the operators is high, which is not conducive to long-term operation and construction.

During the operating process of the paver, it is necessary to continuously supply paving materials to the paver through the feeding car. Limited by a structure for the hopper of the paver, the feeding car needs to be close to a front end of the hopper at an appropriate angle and orientation so that an unloading operation may be carried out normally. Therefore, accuracy of coordination between the feeding car and the paver will affect efficiency of the unloading operation. A common practice is to guide the feeding car to reverse to approach an unloading position of the hopper through visual measuring by the operators or assistants on site. However, accuracy of the visual measuring is not high, which is likely to cause the feeding car to fail to enter an unloading position correctly when reversing. Repeated operations are required for many times, which will affect continuity of material supply to the paver and even cause the paver to stop due to material shortage, seriously affecting quality and efficiency of a paving operation.

During the operating process of the paver, it is necessary to distribute the materials along a width direction of the paver on a road to be paved through a material distribution chute and a spiral material distribution mechanism, so that the materials may be paved and ironed by an ironer in next steps. However, in an actual operation process, it is common that a distribution of materials in the material distribution chute is uneven, resulting in an uneven distribution of materials on the road to be paved, which may cause segregation phenomenon of materials and then affect paving quality of the road. A usual solution is for the operators to adjust an operating state of the spiral material distribution mechanism by visually measuring the material state in the material distribution chute. In some cases, it is necessary to control the paver to stop moving to adjust distribution and conveying for the materials. In the above methods, accuracy of manually visual measuring is low because an overall state of the materials in the material distribution chute may not be obtained and the materials after the distribution operation are uneven, which may cause an invalid operation or a misoperation, thus affecting the paving quality and paving efficiency of the road.

SUMMARY

In a first aspect, an embodiment of the present application provides a paver control system, applied to a paver, including an image acquisition device, a controller and an execution device. The image acquisition device is provided on the paver for acquiring image information of the execution device. The controller is provided on the paver and electrically connected with the image acquisition device and the execution device for controlling the execution device to operate according to the image information acquired by the image acquisition device. The execution device is provided on the paver for operating under a control of the controller. The execution device includes at least one of a driving mechanism, a prompting device and a material distribution device.

In a second aspect, an embodiment of the present application provides a paver, including: a paver body; and the paver control system described above, wherein the image acquisition device and the controller in the paver control system are provided on the paver body and the controller controls the execution device according to the image information.

In a third aspect, the embodiment of the present application provides a paver control method, applied to the paver control system described above. The paver control method includes: acquiring image information of an execution device of the paver; and controlling the execution device to operate according to the image information.

The paver control system, the paver and the paver control method in the embodiment of the present application may control the execution device to operate according to the image information, effectively improve operation accuracy and operation efficiency, reduce possibility of misoperation in a construction process, and reduce labor intensity of operators and their dependence on operation experience.

Additional aspects and advantages in the embodiments of the present application will become apparent in the following description, or will be known through the practice of the present application.

DETAILED DESCRIPTION OF THE EMBODIMENTS

Figure 1:
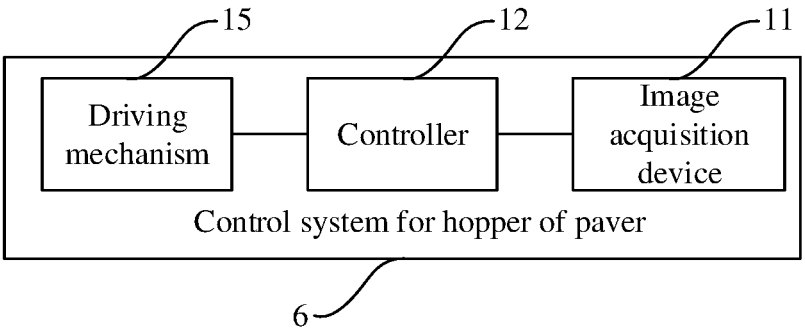
FIG. 1 is a schematic block diagram of a control system for hopper of paver according to an embodiment of the present application.

In order to better understand the above objects, features and advantages of the embodiments according to the present application, the embodiments according to the present application will be further described in detail below in combination with the accompanying drawings and specific embodiments. It should be noted that the embodiments and features in the embodiments of the present application may be combined with each other without conflict.

Many specific details are described in the following description to facilitate a full understanding of the embodiments according to the present application. However, the embodiments according to the present application may also be implemented in other ways different from those described here. Therefore, the scope of protection of the present application is not limited by the specific embodiments disclosed below.

A paver control system, a paver, and a paver control method according to some embodiments of the present application are described below with reference to FIG. 1 to FIG. 43.

An embodiment of the present application provides a paver control system, applied to a paver 2, including: an image acquisition device 11, provided on the paver 2 for acquiring image information of execution devices of the paver 2; a controller 12, provided on the paver 2 and electrically connected with the image acquisition device 11 for controlling the execution devices to operate according to the image information acquired by the image acquisition device 11; and an execution device, provided on the paver 2 for operating under a control of the controller 12. The execution device includes at least one of a driving mechanism 15, a prompting device 14 and a material distribution device. The paver control system includes at least one of a control system 6 for hopper of paver, a guide system 7 for feeding car of paver, and a material distribution system 8 for paver.

The embodiment of the present application provides a paver 2, including a paver body 21 and the paver control system. The image acquisition device 11 and the controller 12 in the paver control system are provided on the paver body 21, and the controller 12 controls an operation of the execution device according to the image information.

The embodiment of the present application provides a paver control method, applied to the paver control system, including the following steps: acquiring image information of an execution device of a paver; and controlling the execution device to operate according to the image information. The paver control method includes at least one of a control method for hopper of paver, a guide method for feeding car of paver and a control method for distributing material of paver.

Figure 2:
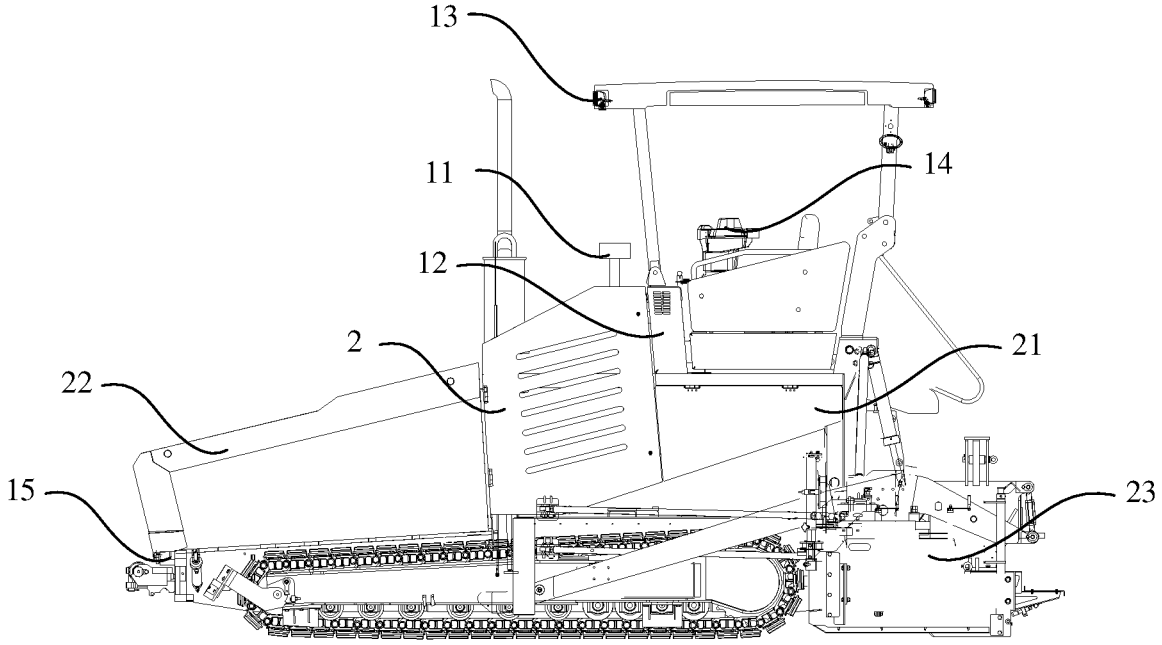
FIG. 2 is a structural diagram of a paver according to an embodiment of the present application.

The embodiment provides a control system 6 for hopper of paver, as shown in FIG. 1 and FIG. 2, including a driving mechanism 15, an image acquisition device 11 and a controller 12.

The driving mechanism 15 is provided on the paver 2 and a driving end of the driving mechanism 15 is connected with a hopper 22 of the paver 2 for driving the hopper 22 to move and realize a spreading or closure of the hopper 22. The image acquisition device 11 and the controller 12 are both provided on the paver 2. The image acquisition device 11 is used to acquire image information of the hopper 22, a material conveying mechanism 221 and a feeding car 3 of the paver 2, and send the acquired image information to the controller 12 as a basis for subsequent control of a movement of the hopper 22. The controller 12 receives the image information acquired by the image acquisition device 11 (as shown in FIG. 3, FIG. 4, FIG. 6 and FIG. 7) and determines a relative position between the feeding car 3 and the hopper 22 according to the image information; at the same time, the controller 12 is electrically connected with the driving mechanism 15, controls the driving mechanism 15 to operate according to the relative position between the feeding car 3 and the hopper 22, and drives the hopper 22 to spread or close, so as to match a state of the hopper 22 with a unloading process of the feeding car 3 to achieve accurate unloading and feeding.

Figure 3:
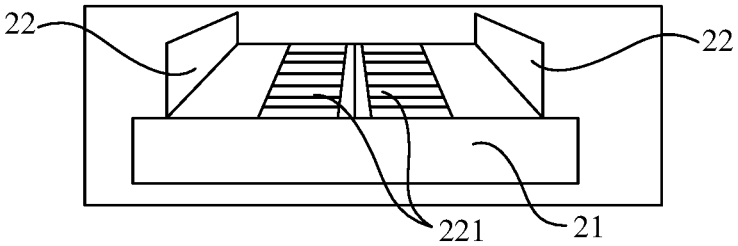
FIG. 3-FIG. 4 both are image schematic diagrams of a hopper according to an embodiment of the present application.
Figure 4:
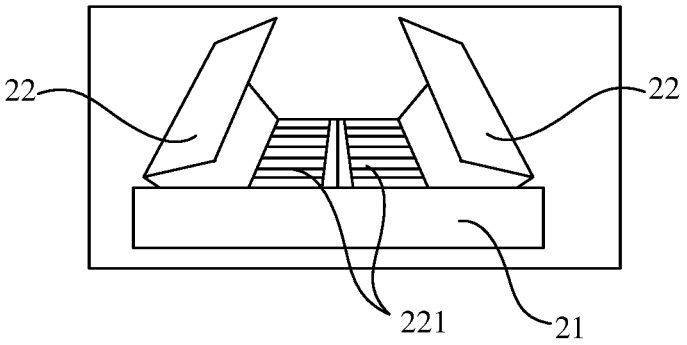

As shown in FIG. 3 and FIG. 4, the hopper 22 is provided with the material conveying mechanism 221 for conveying materials in the hopper 22 to specified positions. Parts of the hopper 22 located on both sides of the material conveying mechanism 221 may rotate relatively to the material conveying mechanism 221 to realize the spreading or closure of the hopper 22. When the hopper 22 is in an unfolded state (as shown in FIG. 3), the feeding car 3 may discharge materials into the hopper 22; when the hopper 22 is in a closed state (as shown in FIG. 4), the materials in the hopper 22 on both sides of the material conveying mechanism 221 may be poured into the material conveying mechanism 221.

The control system 6 for hopper of paver in the embodiment controls the hopper 22 to spread or close according to the image information, so as to match a state of the hopper 22 with a operation process of the feeding car 3 without manually visual measuring, which may effectively improve operation accuracy and efficiency, reduce possibility of misoperation in a construction process, and reduce labor intensity of an operator and dependence on operation experience.

The control system 6 for hopper of paver in the embodiment is further improved on the basis of the embodiments mentioned above.

Figure 5:
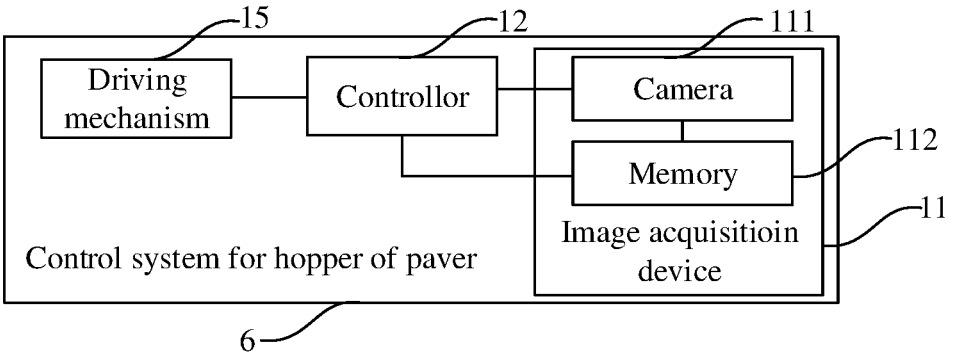
FIG. 5-FIG. 6 both are image schematic diagrams of a hopper and a feeding car according to an embodiment of the present application.

As shown in FIG. 2 and FIG. 5, the image acquisition device 11 specifically includes a camera 111 and a memory 112. The camera 111 is provided on the paver 2 and above the hopper 22 for acquiring the image information and preventing being blocked. The memory 112 is electrically connected with the camera 111 and the controller 12 to store the image information acquired by the camera 111 for easy retrieval and use by the controller 12. A reference image information is stored in the memory 112 for comparison by the controller 12. The reference image information is used to record image positions of the hopper 22 in the unfolded state and the closed state, an image position of the material conveying mechanism 221, and image positions of a tail outline of the feeding car 3 when an area of which is at a first area threshold and a second area threshold. The controller 12 determines a relative position between the feeding car 3 and the hopper 22 by comparing newly acquired image information and the image position in the reference image information, and then carries out corresponding control operation.

Figure 6:
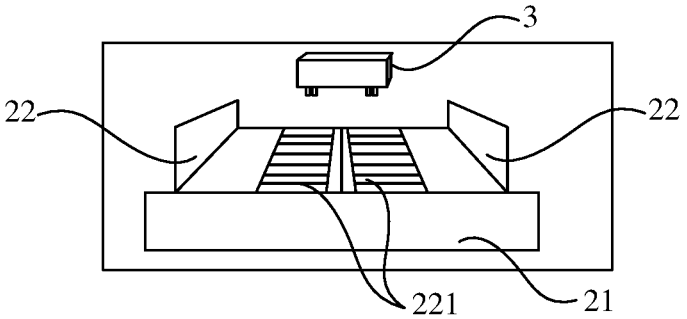
Figure 7:
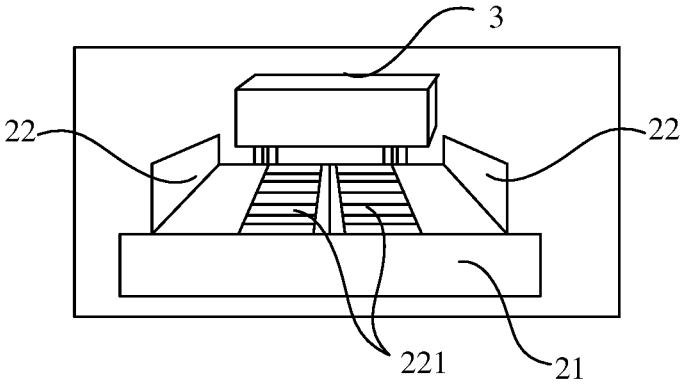
FIG. 7-FIG. 10 are schematic block diagrams of a control system for hopper of paver according to an embodiment of the present application.

FIG. 6 shows image information when a tail outline of the feeding car 3 reaches a first area threshold. At this time, the controller 12 controls the driving mechanism 15 to drive the hopper 22 to spread in preparation for an unloading operation of the feeding car 3. FIG. 7 shows image information when the tail outline of the feeding car 3 reaches a second area threshold. At this time, the feeding car 3 has reached an unloading position and is about to start the unloading operation.

The control system 6 for hopper of paver in the embodiment is further improved on the basis of the embodiments mentioned above.

Figure 8:
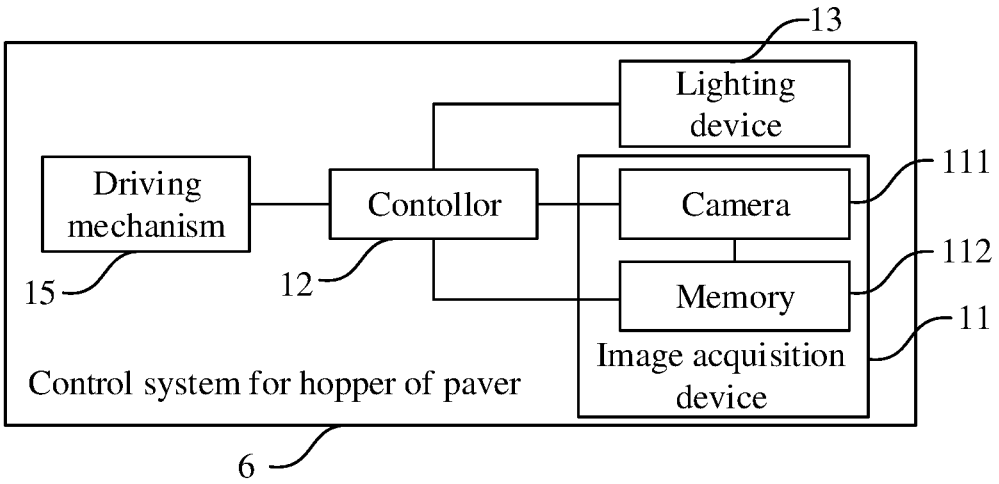

As shown in FIG. 2 and FIG. 8, the control system 6 for hopper of paver also includes a lighting device 13, which is provided on the paver 2. The lighting device 13 is electrically connected with the controller 12, so that when light in a construction environment is dark, the controller 12 controls the lighting device 13 to provide lighting for the camera 111. Specifically, the lighting device 13 may be provided on a top of the paver 2, so as to provide lighting for an image acquisition area of the camera 111, reduce an impact of light on the image information, and expand scope of application of the control system 6 for hopper of paver. The lighting device 13 may also be provided at a front of the paver 2 or on the camera 111.

The control system 6 for hopper of paver in the embodiment is further improved on the basis of the embodiments mentioned above.

Figure 9:
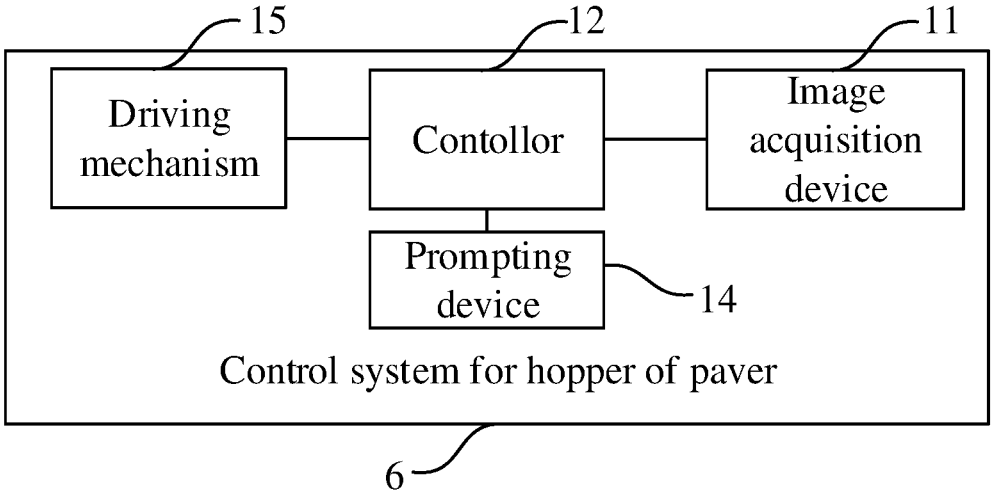

As shown in FIG. 2 and FIG. 9, the control system 6 for hopper of paver also includes a prompting device 14 for outputting prompting information. Specifically, the prompting device 14 is an alarm device, which is provided on the paver 2 and electrically connected with the controller 12 to output alarm prompting information under a control of the controller 12 when the hopper 22 is in abnormal conditions, so as to alert a driver of the feeding car 3 and an operator on a construction site.

It should be noted that the prompting device 14 may also be provided on the feeding car 3 and electrically connected with the controller 12 through a wireless signal. Of course, the prompting device 14 is not limited to the alarm device in the embodiment, but may also be a display device, an indicator device or other forms of audio output devices, such as voice devices, which may be provided on the paver 2 and/or the feeding car 3, and may all serve as a reminder in the embodiment. Contents of the prompting information may correspond to abnormal conditions, operation reminders or other information.

Figure 10:
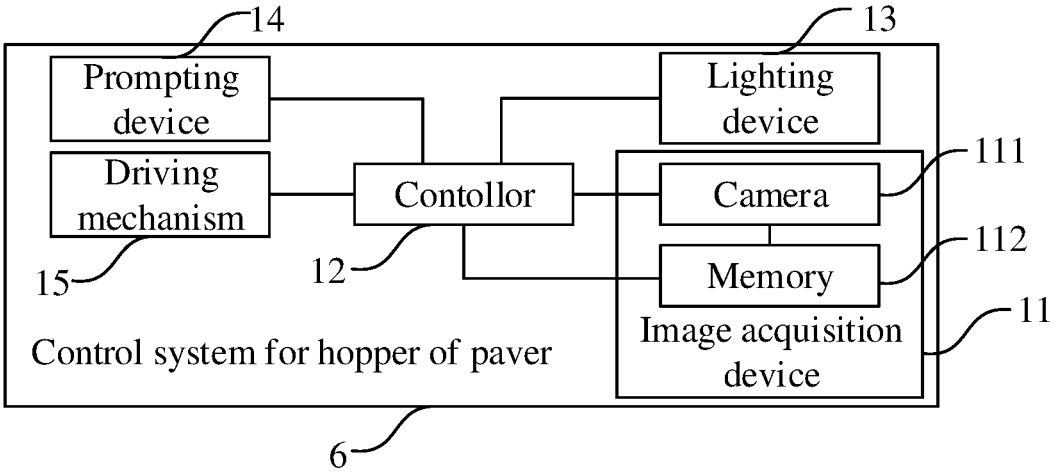

The embodiment provides a control system 6 for hopper of paver, as shown in FIG. 2 and FIG. 10, including a driving mechanism 15, an image acquisition device 11, a controller 12, a lighting device 13 and a prompting device 14.

The driving mechanism 15 is provided on the paver 2, and a driving end of the driving mechanism 15 is connected with a hopper 22 of the paver 2 for driving the hopper 22 to move and realize a spreading or closure of the hopper 22. As shown in FIG. 3 and FIG. 4, the hopper 22 is provided with the material conveying mechanism 221 for conveying the materials in the hopper 22 to the specified positions. Parts of the hopper 22 located on both sides of the material conveying mechanism 221 may rotate relatively to the material conveying mechanism 221 to realize the spreading or closure of the hopper 22. When the hopper 22 is in the unfolded state (as shown in FIG. 3), the feeding car 3 may discharge the materials into the hopper 22; when the hopper 22 is in the closed state (as shown in FIG. 4), the materials in the hopper 22 on both sides of the material conveying mechanism 221 may be poured into the material conveying mechanism 221.

The image acquisition device 11 specifically includes the camera 111 and the memory 112. The camera 111 is provided on the paver 2 and above the hopper 22 for acquiring the image information and preventing being blocked. The memory 112 is electrically connected with the camera 111 and the controller 12 to store the image information acquired by the camera 111. A reference image information is stored in the memory 112 for comparison by the controller 12. The reference image information is used to record the image position of the hopper 22 in the unfolded state and the closed state, the image position of the material conveying mechanism 221, and the image positions of the tail outline of the feeding car 3 when an area of which is at a first area threshold and a second area threshold. The controller 12 determines the relative position between the feeding car 3 and the hopper 22 by comparing the newly acquired image information and the image position in the reference image information, and then carries out corresponding control operation. FIG. 6 shows the image information when the tail outline of the feeding car 3 reaches the first area threshold. At this time, the controller 12 controls the driving mechanism 15 to drive the hopper 22 to spread in preparation for the unloading operation of the feeding car 3. FIG. 7 shows the image information when the tail outline of the feeding car 3 reaches the second area threshold. At this time, the feeding car 3 has reached the unloading position and is about to start the unloading operation.

The lighting device 13 is provided on the top of the paver 2. The lighting device 13 is electrically connected with the controller 12, so that when the light in the construction environment is dark, the controller 12 controls the lighting device 13 to provide lighting for the image acquisition area of the camera 111, so as to reduce the impact of light on the image information and expand the scope of the control system 6 for hopper of paver.

The controller 12 is electrically connected with the driving mechanism 15 and the image acquisition device 11. The controller 12 receives the image information acquired by the image acquisition device 11, determines the relative position between the feeding car 3 and the hopper 22 according to the image information, and then controls the operation of the driving mechanism 15 according to the relative position between the feeding car 3 and the hopper 22 to drive the hopper 22 to spread or close, so as to match the state of the hopper 22 with the unloading process of the feeding car 3 to achieve accurate unloading and feeding.

The prompting device 14 is provided on the paver 2 for outputting the prompting information. Specifically, the prompting device 14 is an alarm device, which is electrically connected with the controller 12 to output the alarm prompting information under the control of the controller 12 when the hopper 22 is in the abnormal conditions, so as to alert the driver of the feeding car 3 and the operator on the construction site.

It should be noted that the prompting device 14 may also be provided on the feeding car 3 and electrically connected with the controller 12 through a wireless signal. Of course, the prompting device 14 is not limited to the alarm device in the embodiment, but may also be a display device, an indicator device or other forms of audio output equipment, such as voice devices, which may be provided on the paver 2 and/or the feeding car 3, which may all serve as a reminder in the embodiment. The contents of the prompting information may correspond to abnormal conditions, operation reminders or other information.

The hopper control system 6 of the paver in the embodiment may control the hopper 22 to spread or close according to the image information, so as to match the state of the hopper 22 with the operation process of the feeding car 3. Without manually visual measuring, it may effectively improve the operation accuracy and efficiency, reduce the possibility of misoperation in the construction process, and reduce the labor intensity of the operators and their dependence on the operation experience.

Figure 11:
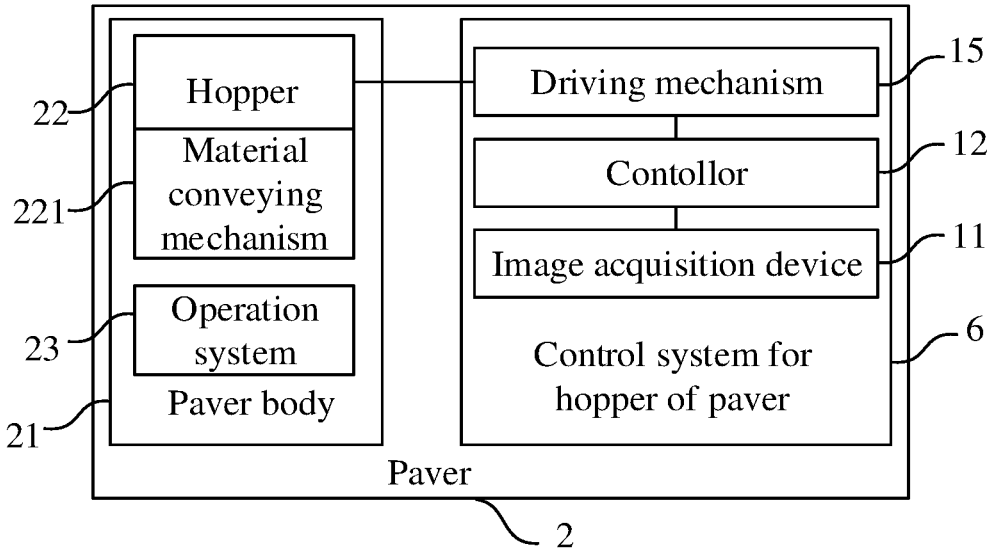
FIG. 11 is a schematic block diagram of a paver according to an embodiment of the present application.

The embodiment provides a paver 2, as shown in FIG. 2 and FIG. 11. The paver 2 includes the paver body 21, the hopper 22 and the control system 6 for hopper of paver in any of the above embodiments.

The paver body 21 is used to carry an operation system 23 and the paving operation is realized through the travelling of the paver body 21. The hopper 22 is provided at the front of the paver body 21 for receiving the materials transported by the feeding car 3. As shown in FIG. 3 and FIG. 4, the hopper 22 is provided with a material conveying mechanism 221 along a length direction of the paver body 21 for conveying the materials from the hopper 22 to the operation system 23. Parts of the hopper 22 located on both sides of the material conveying mechanism 221 may rotate relative to the material conveying mechanism 221 to realize the spreading or closure of the hopper 22. When the hopper 22 is in an unfolded state (as shown in FIG. 3), the feeding car 3 may discharge materials into the hopper 22; when the hopper 22 is in a closed state, the parts of the hopper 22 on both sides of the material conveying mechanism 221 are controlled to rotate upward relative to the material conveying mechanism 221 (as shown in FIG. 4), so as to pour materials into the material conveying mechanism 221, that is, the materials in the hopper 22 outside the material conveying mechanism 221 are poured into the material conveying mechanism 221, so as to facilitate a conveying operation.

The image acquisition device 11 in the control system 6 for hopper of paver is provided on the paver body 21 for acquiring the image information of the hopper 22, the material conveying mechanism 221 and the feeding car 3 (as shown in FIG. 6 and FIG. 7); a drive end of the drive mechanism 15 in the control system 6 for hopper of paver is connected with the hopper 22 to drive a partial rotation of the hopper 22 on both sides of the material conveying mechanism 221; the controller 12 in the control system 6 for hopper of paver is electrically connected with the image acquisition device 11 and the driving mechanism 15 to determine a relative position between the hopper 22 and the conveying car 3 according to the image information acquired by the image acquisition device 11, controls the driving mechanism 15 to operate, and then drives the hopper 22 to spread or close, so as to cooperate with the feeding car 3 to complete the unloading operation.

The paver 2 of the embodiment may effectively improve the accuracy and operation efficiency of unloading from the feeding car 3 to the hopper 22, and reduce the labor intensity of the operator and the dependence on the operation experience. In addition, the paver 2 in the embodiment also has all the beneficial effects of the control system 6 for hopper of paver in any of the above embodiments, which will not be repeated here.

Figure 12:
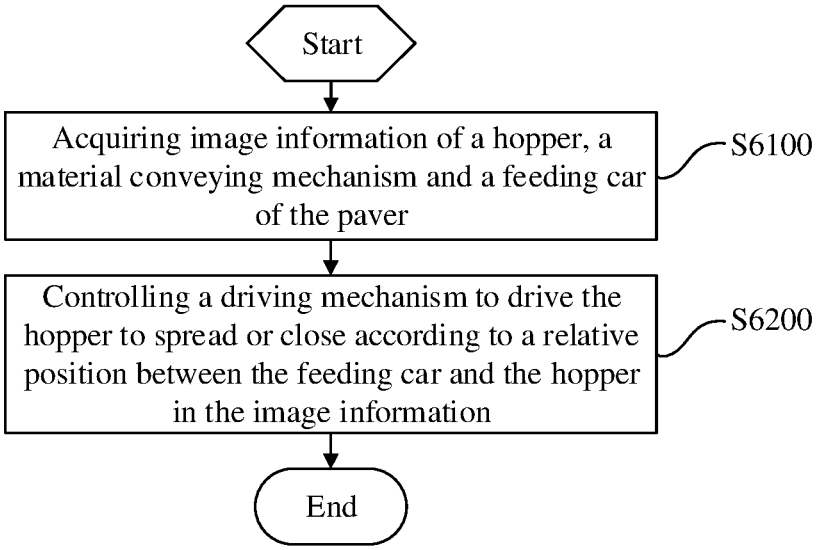
FIG. 12-FIG. 16 are flowcharts of a control method for hopper of paver according to an embodiment of the present application.

The embodiment provides a control method for hopper of paver, as shown in FIG. 12, including the following method steps.

Step S6100: acquiring image information of a hopper, a material conveying mechanism and a feeding car of the paver.

Step S6200: controlling a driving mechanism to drive the hopper to spread or close according to a relative position between the feeding car and the hopper in the image information.

The material conveying mechanism is provided on the hopper and the hopper is used to receive materials of the feeding car in an unfolded state and discharge the materials into the material conveying mechanism in a closed state.

In the embodiment, the image information of the hopper, the material conveying mechanism and the feeding car of the paver is acquired to determine the relative position between the feeding car and the hopper according to the image information, and then the driving mechanism is controlled to spread or close the hopper, so as to cooperate with the operation process of the feeding car to realize normal unloading.

Figure 13:
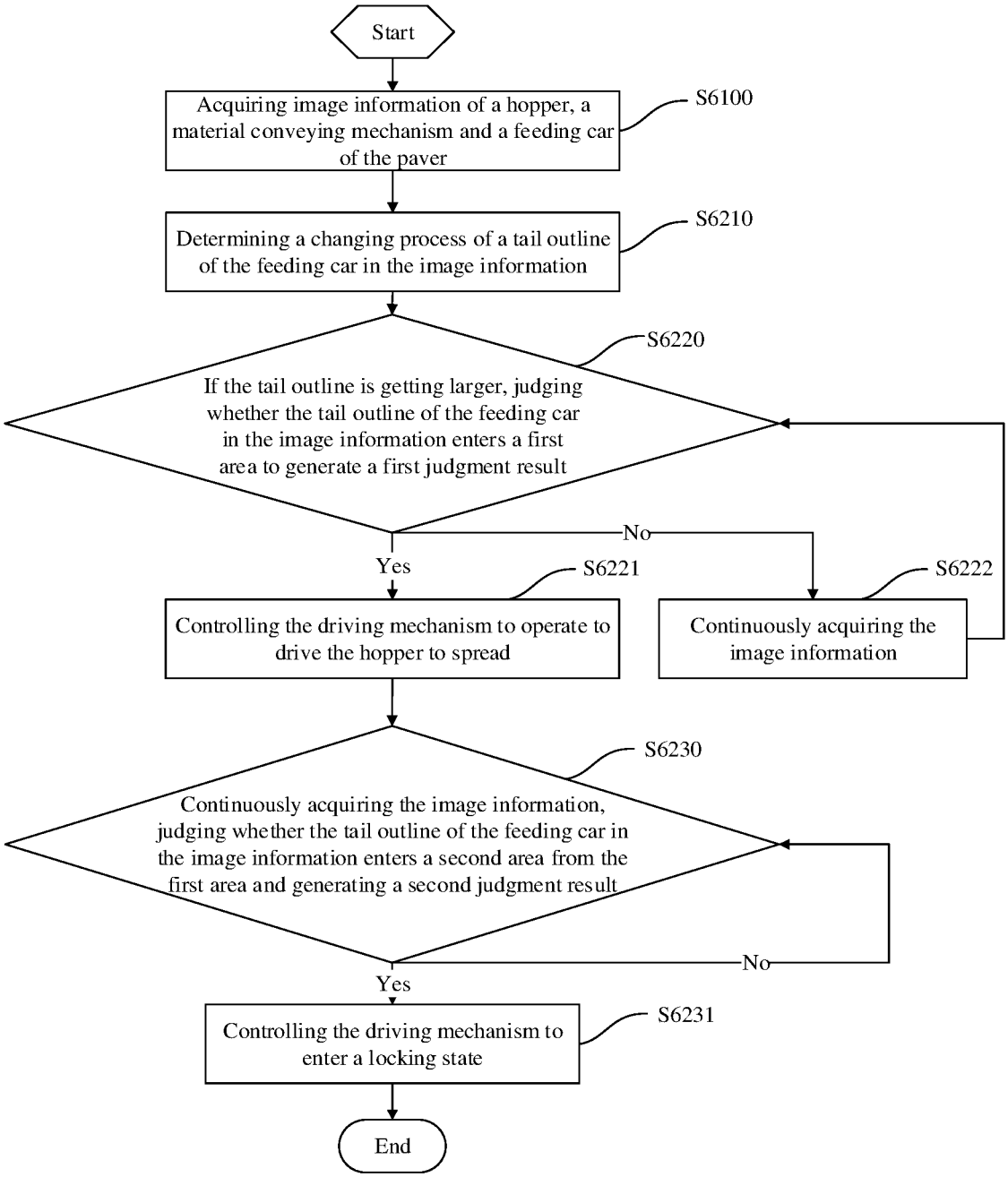

The embodiment provides a control method for hopper of paver, as shown in FIG. 13, including the following method steps.

Step S6100: acquiring image information of a hopper, a material conveying mechanism and a feeding car of the paver.

Step S6210: determining a changing process of a tail outline of the feeding car in the image information.

Step S6220: if the tail outline is getting larger, judging whether the tail outline of the feeding car in the image information enters a first area and generating a first judgment result.

If the first judgment result is yes, executing Step S6221: controlling the driving mechanism to operate to drive the hopper to spread.

If the first judgment result is no, executing Step S6222: continuously acquiring the image information and executing Step S6220.

Step S6230: continuously acquiring the image information, judging whether the tail outline of the feeding car in the image information enters a second area from the first area and generating a second judgment result.

If the second judgment result is yes, executing Step S6231: controlling the driving mechanism to enter a locking state.

If the second judgement result is no, executing Step S6230.

The material conveying mechanism is provided on the hopper and the hopper is used to receive the materials of the feeding car in an unfolded state and discharge the materials to the material conveying mechanism in a closed state.

In the embodiment, Step S6200 is further defined on the basis of the embodiments mentioned above. Through Step S6210, the changing process of the tail outline of the feeding car in the image information is determined to judge whether the feeding car is gradually approaching the paver or away from the paver. Through Step S6220 to Step S6222, when the tail outline of the feeding car in the image information is getting larger, that is, when the feeding car gradually approaches the hopper, the tail outline of the feeding car in the image information is judged whether having entered the first area and when the tail outline of the feeding car enters the first area, the driving mechanism is controlled to drive the hopper to spread to prepare for the unloading operation of the feeding car. Otherwise, the image information is continuously acquired and the judgement in Step S6220 is executed again. After the feeding car enters the first area, the image information is continuously acquired through Step S6230 to further determine whether the tail outline of the feeding car in the image information enters the second area from the first area, so as to determine whether the feeding car reaches the unloading position. When the tail outline of the feeding car enters the second area, the driving mechanism is controlled to enter the locking state through Step S6231 to keep the hopper locked in the unfolded state, so as to prevent the feeding car from interfering with the hopper of the feeding car due to a misoperation and closure of the hopper during the unloading process and ensure the accuracy of the operation. The first area is a preset area and the actual distance between a boundary line of the first area and the hopper is a first distance which ranges from 1 m to 5 m. The second area corresponds to the unloading position.

Figure 14:
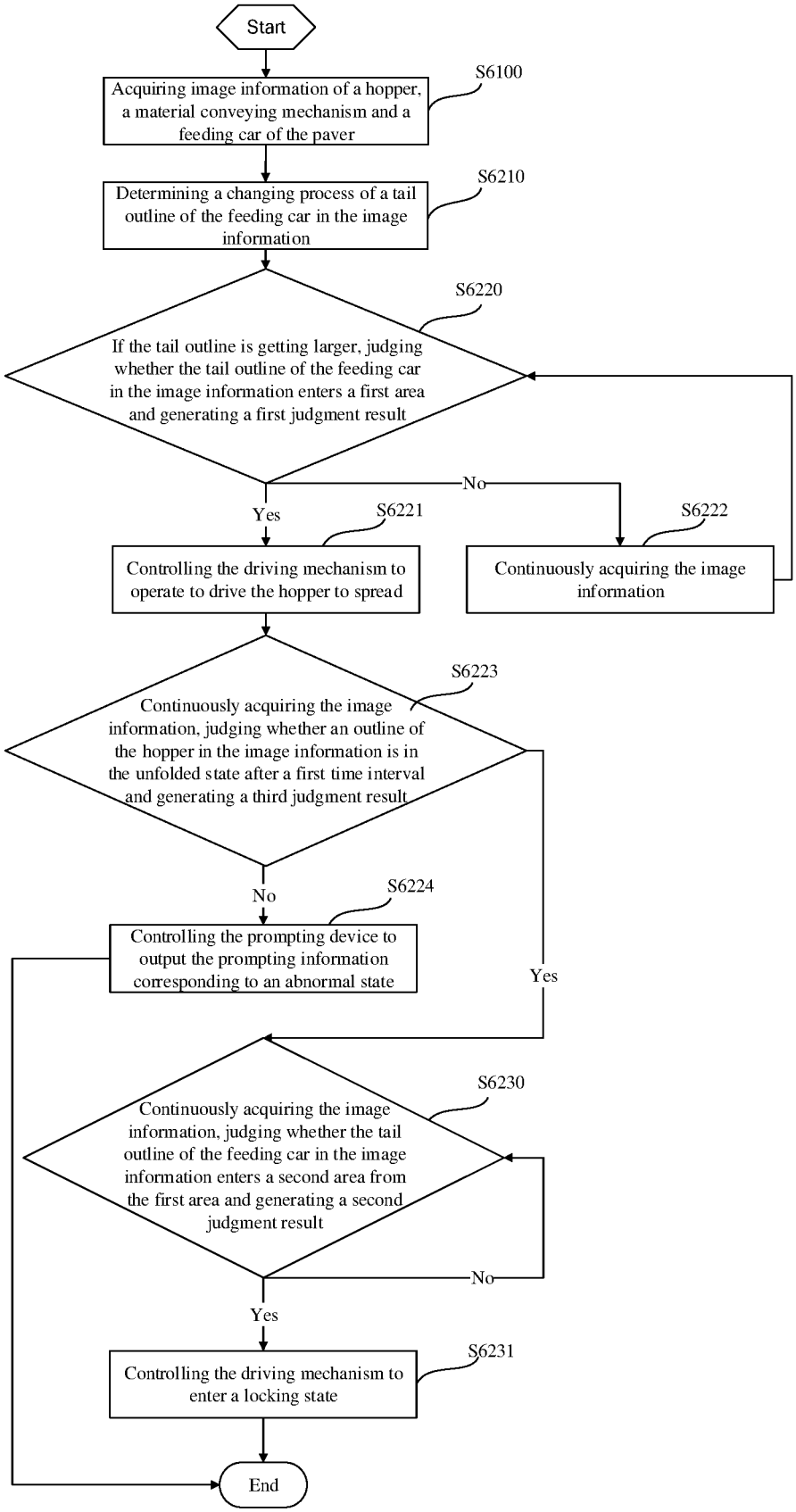

The embodiment provides a control method for hopper of paver, as shown in FIG. 14, including the following method steps.

Step S6100: acquiring image information of a hopper, a material conveying mechanism and a feeding car of the paver.

Step S6210: determining a changing process of a tail outline of the feeding car in the image information.

Step S6220: if the tail outline is getting larger, judging whether the tail outline of the feeding car in the image information enters a first area and generating a first judgment result.

If the first judgment result is yes, executing Step S6221: controlling the driving mechanism to operate to drive the hopper to spread.

If the first judgment result is no, executing Step S6222: continuously acquiring the image information and executing Step S6220.

Step S6223: continuously acquiring the image information, judging whether an outline of the hopper in the image information is in the unfolded state after a first time interval and generating a third judgment result.

If the third judgment result is yes, executing Step S6230.

If the third judgment result is no, executing Step S6224.

Step S6224: controlling the prompting device to output the prompting information corresponding to an abnormal state.

Step S6230: continuously acquiring the image information, judging whether the tail outline of the feeding car in the image information enters a second area from the first area and generating a second judgment result.

If the second judgment result is yes, executing Step S6231: controlling the driving mechanism to enter a locking state.

If the second judgment result is no, executing Step S6230.

The material conveying mechanism is provided on the hopper and the hopper is used to receive the materials of the feeding car in the unfolded state and discharge the materials into the material conveying mechanism in a closed state.

In the embodiment, Step S6223 to Step S6224 are added to the technology of the embodiments mentioned above. A prompting device is provided on the paver or the feeding car to output the prompting information. After Step S6221, a second confirmation of the actual state of the hopper is realized through Step S6223 to prevent the hopper from not being fully spread or affecting the unloading operation of the feeding car due to abnormal conditions. When the hopper is not in the unfolded state, the prompting device is controlled to output prompting information through Step S6224 to remind the driver of the feeding car to stop, so as to prevent interference with the feeding bin of the feeding car when the hopper is not spread and affect the subsequent unloading operation. At the same time, the operator of the paver may also be reminded to take measures against abnormal conditions in time. When the hopper is in the normal unfolded state, Step S6230 is normally executed. When the prompting device is provided on the feeding car, the prompting device may be a display device, an audio output device, an indicator device or other devices that may output prompting information; and the prompting information includes but is not limited to image, text, sound (including voice) or indicator signal. When the prompting device is only provided on the paver, the prompting device is an audio output device.

Figure 15:
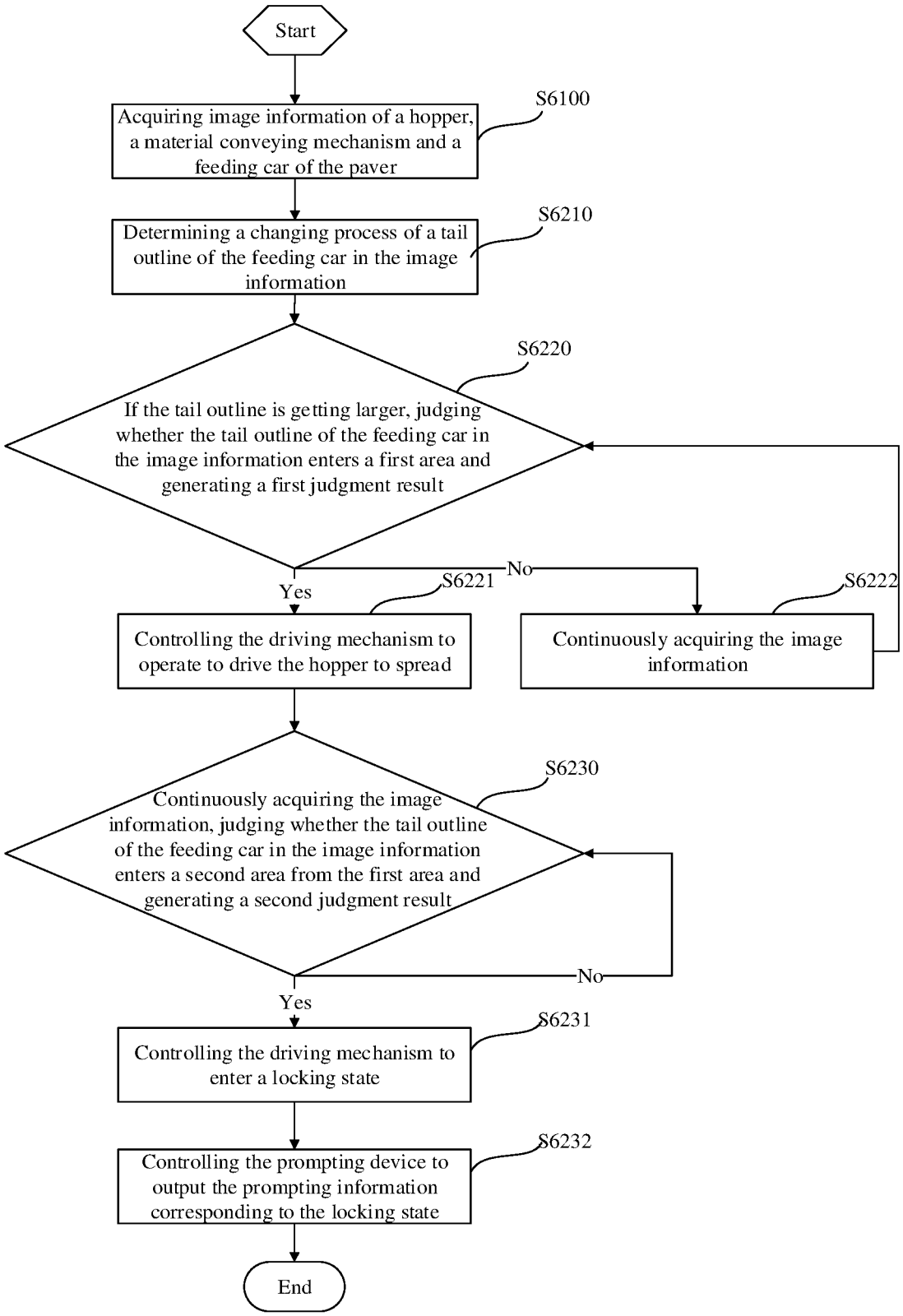

The embodiment provides a control method for hopper of paver, as shown in FIG. 15, including the following method steps.

Step S6100: acquiring image information of a hopper, a material conveying mechanism and a feeding car of the paver.

Step S6210: determining a changing process of a tail outline of the feeding car in the image information.

Step S6220: if the tail outline is getting larger, judging whether the tail outline of the feeding car in the image information enters a first area and generating a first judgment result.

If the first judgment result is yes, executing Step S6221: controlling the driving mechanism to operate to drive the hopper to spread.

If the first judgment result is no, executing Step S6222: continuously acquiring the image information and executing Step S6220.

Step S6230: continuously acquiring the image information, judging whether the tail outline of the feeding car in the image information enters a second area from the first area and generating a second judgment result.

If the second judgment result is yes, executing Step S6231: controlling the driving mechanism to enter a locking state.

If the second judgement result is no, executing Step S6230.

Step S6232: controlling the prompting device to output the prompting information corresponding to the locking state.

The material conveying mechanism is provided on the hopper and the hopper is used to receive the materials of the feeding car in an unfolded state and discharge the materials into the material conveying mechanism in a closed state.

In the embodiment, Step S6232 is added to the embodiments mentioned above. The prompting device is provided on the paver or the feeding car to output prompting information. After Step S6231, the prompting device is controlled to output the prompting information corresponding to the locking state of the hopper through Step S6232 to remind the driver of the feeding car that the feeding car has reached the unloading position, the hopper is locked in the unfolded state and the unloading is ready, so as to improve the efficiency of the driver of the feeding car in obtaining the relative position between the feeding car and the hopper. When the prompting device is provided on the feeding car, the prompting device may be a display device, an audio output device, an indicator device or other devices that may output prompting information and the prompting information includes but is not limited to image, text, sound (including voice) or indicator signal. When the prompting device is only provided on the paver, the prompting device is an audio output device.

Figure 16:
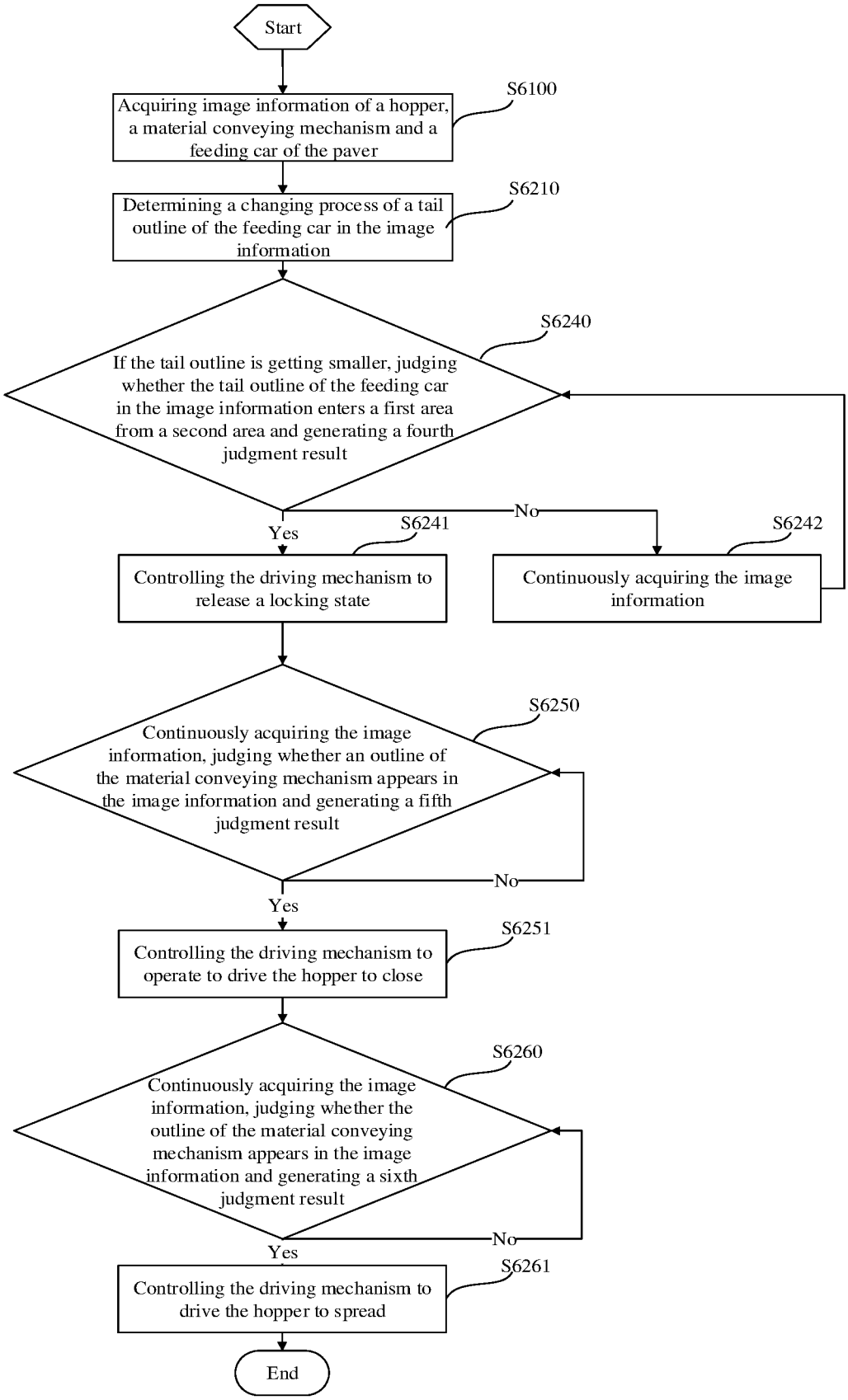
Figure 17:
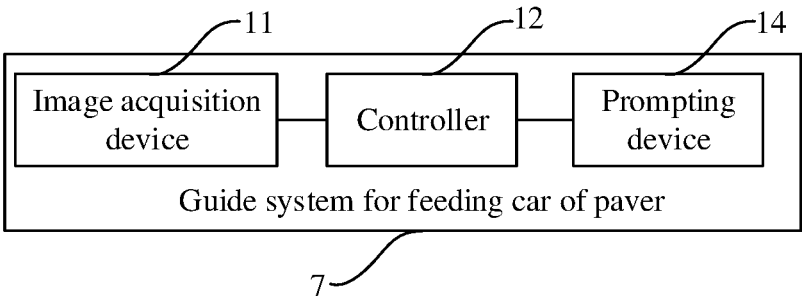
FIG. 17 is a schematic block diagram of a guide system for feeding car of paver according to an embodiment of the present application.

The embodiment provides a control method for hopper of paver, as shown in FIG. 16, including the following method steps.

Step S6100: acquiring image information of a hopper, a material conveying mechanism and a feeding car of the paver.

Step S6210: determining a changing process of the tail outline of the feeding car in the image information.

Step S6240: if the tail outline is getting smaller, judging whether the tail outline of the feeding car in the image information enters a first area from a second area and generating a fourth judgment result.

If the fourth judgment result is yes, executing Step S6241: controlling the driving mechanism to release a locking state.

If the fourth judgment result is no, executing Step S6242: continuously acquiring the image information.

Step S6250: continuously acquiring the image information, judging whether an outline of the material conveying mechanism appears in the image information and generating a fifth judgment result.

If the fifth judgment result is yes, executing Step S6251: controlling the driving mechanism to operate to drive the hopper to close; if the fifth judgment result is no, executing Step S6250.

Step S6260: continuously acquiring the image information, judging whether the outline of the material conveying mechanism appears in the image information and generating a sixth judgment result.

If the sixth judgment result is yes, executing Step S6261: controlling the driving mechanism to drive the hopper to spread; if the sixth judgment result is no, executing Step S6260.

In the embodiment, Step S6200 is further defined on the basis of the embodiments mentioned above. Through Step S6210, the changing process of the tail outline of the feeding car in the image information is determined to judge whether the feeding car is gradually approaching the hopper or away from the hopper. When the tail outline of the feeding car in the image information is getting smaller, that is, when the feeding car is gradually getting away from the hopper, at this time, the tail outline of the feeding car in the image information is judged that whether it has entered the first area from the second area through Step S6240 to Step S6242, so as to judge whether the feeding car has completed unloading and left the unloading position. If the tail outline of the feeding car enters the first area from the second area, the driving mechanism is controlled to release the locking state, so as to facilitate driving the hopper. Otherwise, continuously acquiring the image information and fully executing Step S6240. After the feeding car enters the first area, whether the materials on the material conveying mechanism have been transported to the specified position is determined through Step S6250. When the outline of the material conveying mechanism appears in the image information, the hopper is controlled to close through Step S6251, so that the materials on both sides of the material conveying mechanism on the hopper fall into the material conveying mechanism under gravity, preventing accumulation of materials on both sides of the material conveying mechanism in the hopper; otherwise, Step S6250 is executed repeatedly. Then, in Step S6260, whether the outline of the material conveying mechanism appears in the image information is judged again to determine whether the materials on the material conveying mechanism are transported to the specified position. When the outline of the material conveying mechanism reappears in the image information, it may be determined that the materials in the hopper are transported and at this time, the driving mechanism may be controlled to drive the hopper to spread for preparation of next unloading.

It should be noted that parts on both sides of the material conveying mechanism on the hopper may rotate relatively to the material conveying mechanism. When the hopper is in the closed state, the parts on both sides of the material conveying mechanism on the hopper rotate above the material conveying mechanism without blocking the material conveying mechanism and at this time, the image acquisition device may still acquire the image of the material conveying mechanism.

The technical solutions according to some embodiments of the present application are described in detail above in combination with the attached drawings. The hopper may be controlled to spread or close according to the image information, so that the state of the hopper is matched with the operation process of the feeding car, which may effectively improve the operation accuracy and efficiency and reduce the labor intensity of the operator and the dependence on the operation experience.

The embodiment provides a guide system 7 for feeding car of paver, as shown in FIG. 17 to FIG. 20, including an image acquisition device 11, a prompting device 14 and a controller 12.

Figure 19:
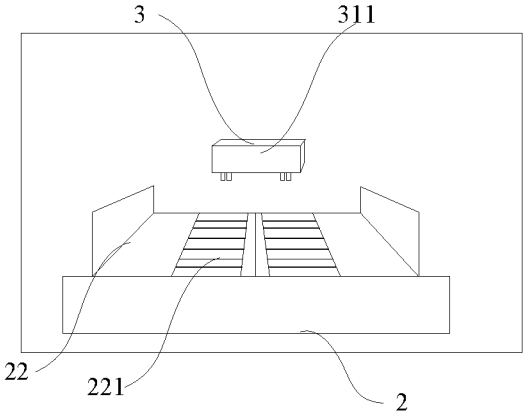
FIG. 19-FIG. 20 are image schematic diagrams of a front end of a hopper according to an embodiment of the present application.
Figure 20:
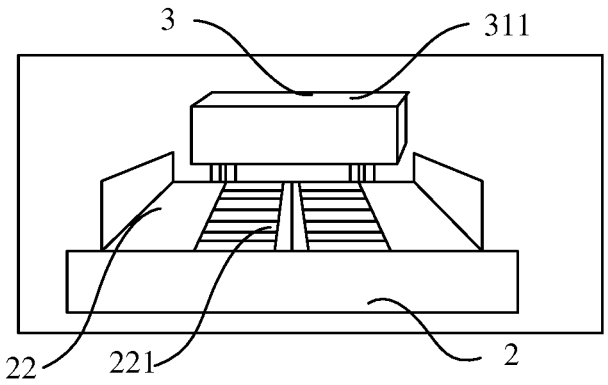

The image acquisition device 11 and the controller 12 are provided on the paver 2, and the prompting device 14 is provided on the feeding car 3. The image acquisition device 11 is located above the hopper 22 of the paver 2 and faces the front of the hopper 22 to acquire image information of the hopper 22 and the feeding car 3 (FIG. 19 and FIG. 20 illustrate the schematic diagram of the image information of the feeding car 3 at different positions of the hopper 22 respectively). The controller 12 is electrically connected with the image acquisition device 11 and the prompting device 14. The controller 12 may acquire the image information acquired by the image acquisition device 11 and determine a relative position between the feeding car 3 and the hopper 22 according to the image information so as to control the prompting device 14 to output the corresponding prompting information for guidance, such as the prompting information for guidance corresponding to straight-line reversing, moving forward, turning and merging, reminding and guiding the operation of the driver of the feeding car 3 to guide the driver of the feeding car 3 to reverse to the unloading position of the hopper 22 and discharge materials into the hopper 22 to ensure continuity of the material supply for the paver 2. In addition, the controller 12 may also control the prompting device 14 to output the corresponding prompting information for guidance according to the image position of the materials 5 in the image information, such as the prompting information for guidance corresponding to lifting, remaining and lowering of the feeding bin 31. The prompting device 14 may be a combination of one or more of a display device, an audio output device, and an indicator device. The prompting information for guidance includes but is not limited to image, text, sound (including voice) or indicator signal. The controller 12 and the prompting device 14 may be connected by wireless signals, such as wireless network signals, mobile communication network signals and Bluetooth signals.

The guide system 7 for feeding car of paver in the embodiment may control the prompting device 14 to output the corresponding prompting information for guidance according to the image information, so as to guide the operation of the driver of the feeding car 3 without manual observation. The efficiency and accuracy of information transmission are higher, which is conducive to improving efficiency of the feeding car 3 supplying for the hopper 22 of the paver 2, so as to meet demand of the paver 2 for continuity of feeding. At the same time, it may effectively reduce the labor intensity of the operator in construction site and reduce potential safety hazards.

The guide system 7 for feeding car of paver in the embodiment is further improved on the basis of the embodiments mentioned above.

As shown in FIG. 18 to FIG. 22, the image acquisition device 11 includes a camera 111 and a memory 112. The camera 111 is provided on the paver 2 and above the hopper 22. The camera 111 faces the front end of the hopper 22, so as to acquire the image information of the hopper 22 and the feeding car 3 and prevent the camera 111 from being blocked. The memory 112 is electrically connected with the camera 111 to store the image information acquired by the camera 111. The memory 112 also stores reference image information, which is used to record images of tail outlines of the feeding car 3, the feeding bin 31, the materials 5 and the hopper 22 in different states for reference.

The controller 12 is electrically connected with the camera 111 and the memory 112 to control an operation of the camera 111 and the memory 112. The controller 12 acquires the newly acquired image information and reference image information through the memory 112, and determines a relative position between the feeding car 3 and the hopper 22 or a material state in the feeding bin 31 by comparison, so as to control the prompting device 14 to output the corresponding prompting information for guidance. The judgment accuracy is higher, which is conducive to improving the operation accuracy and efficiency of the feeding car 3.

The guide system 7 for feeding car of paver in the embodiment is further improved on the basis of the embodiments mentioned above.

Figure 18:
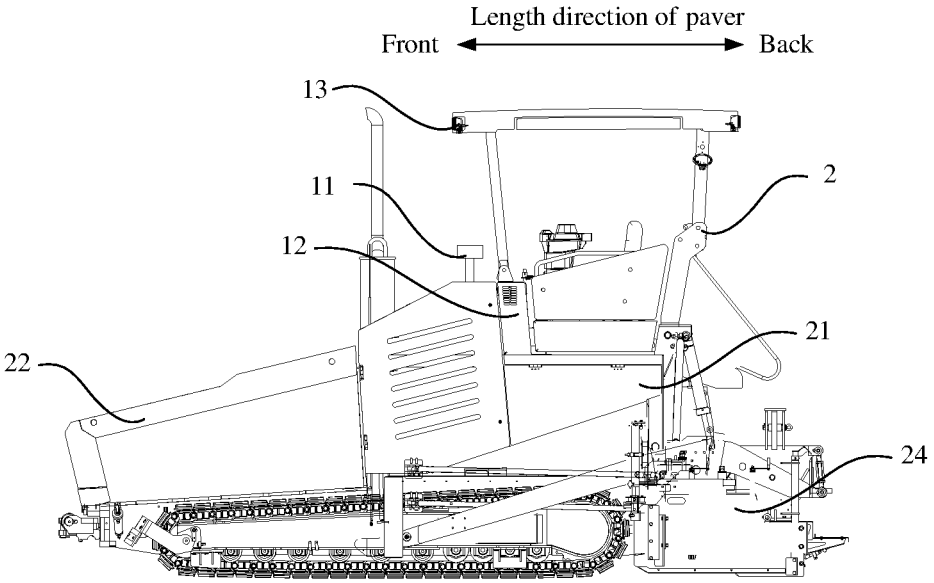
FIG. 18 is a structural diagram of a paver according to an embodiment of the present application.
Figure 22:
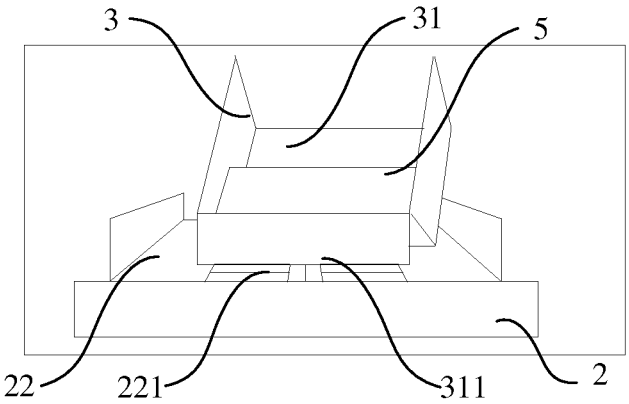
FIG. 22 is an image schematic diagram of a front end of a hopper according to an embodiment of the present application.
Figure 23:
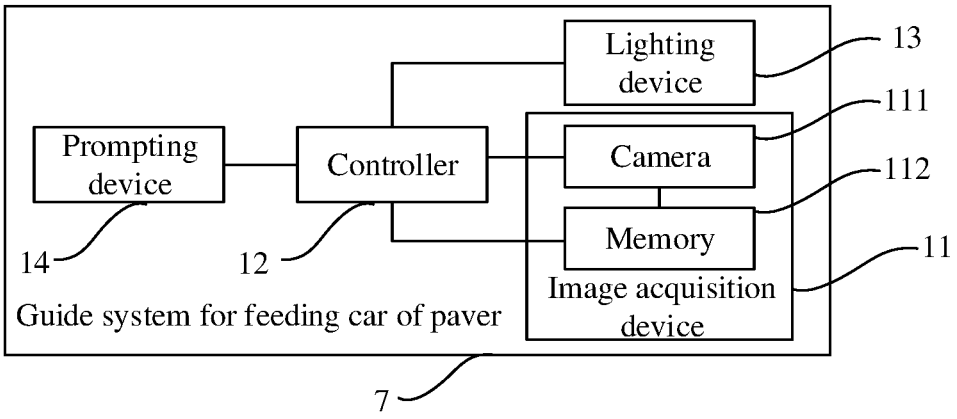
FIG. 23-FIG. 25 are schematic block diagrams of a guide system for feeding car of paver according to an embodiment of the present application.

As shown in FIG. 18, FIG. 22 and FIG. 23, the guide system 7 for feeding car of paver further includes a pressure detector 16, which is provided on the material conveying mechanism 221 of the paver 2 for detecting a conveying pressure of the material conveying mechanism 221. The controller 12 is electrically connected with the pressure detector 16 to acquire detection data of the pressure detector 16, determine an amount of material conveyed by the material conveying mechanism 221 according to the conveying pressure of the material conveying mechanism 221, and then control the prompting device 14 to output prompting information for guidance corresponding to the unloading operation, such as guiding lifting, remaining or lowering of the feeding bin 31 of the feeding car 3, or adjusting a lifting speed of the feeding bin 31. The pressure detector 16 is provided in a hydraulic pump of the material conveying mechanism 221 and determines the conveying pressure of the material conveying mechanism 221 by detecting a fluid pressure.

The guide system 7 for feeding car of paver in the embodiment is further improved on the basis of the embodiments mentioned above.

Figure 24:
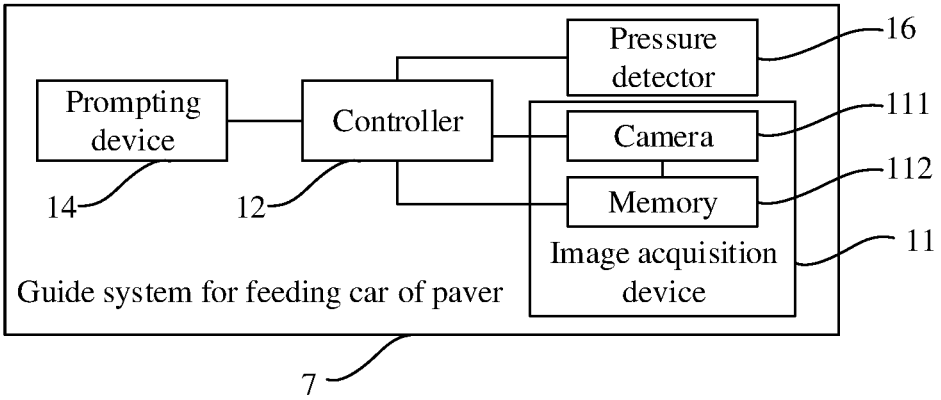

As shown in FIG. 18 and FIG. 24, the guide system 7 for feeding car of paver further includes a lighting device 13, which is provided on the paver 2 for providing lighting for image acquisition area of the image acquisition device 11. When the construction environment is dark or at night, lighting may be provided through the lighting device 13 to reduce the impact of the light on the image information, so that guide system 7 for feeding car of paver may still operate normally at night or in dark environments such as tunnels, improving adaptability of the guide system 7 for feeding car of paver and expanding scope of application of the paver 2. The lighting device 13 may be provided at a position shown in FIG. 18 or directly on the camera 111 to make an angle of light be consistent with a lens angle of the camera 111, which may further reduce the impact of light on image acquisition.

The guide system 7 for feeding car of paver in the embodiment includes an image acquisition device 11, a prompting device 14, a controller 12, a pressure detector 16 and a lighting device 13.

Figure 25:
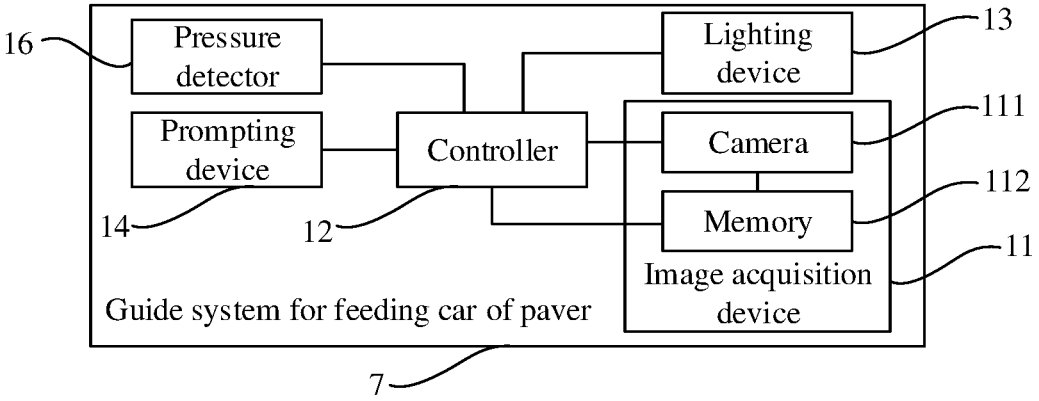

As shown in FIG. 18 and FIG. 25, the image acquisition device 11, the controller 12, the pressure detector 16 and the lighting device 13 are provided on the paver 2 and the prompting device 14 is provided on the feeding car 3. The prompting device 14 is provided on the feeding car 3 to output prompting information for guidance to guide and remind the driver of the feeding car 3. The prompting device 14 may be specifically provided in a cockpit. The controller 12 is electrically connected with the camera 111, the memory 112 and the prompting device 14 to control the operation of the camera 111, the memory 112 and the prompting device 14. The controller 12 acquires newly acquired image information and reference image information through the memory 112, determines a relative position between the feeding car 3 and the hopper 22 or the material state in the feeding bin 31 through comparison, so as to control the prompting device 14 to output the corresponding prompting information for guidance to guide the feeding car 3 to perform corresponding operations. Specifically, the controller 12 may determine the relative position between the feeding car 3 and the hopper 22 according to the image information, and then control the prompting device 14 to output the corresponding prompting information for guidance, such as the prompting information for guidance corresponding to straight-line reversing, moving forward, turning and merging, so as to guide the feeding car 3 to reverse to the unloading position of the hopper 22 for facilitating the unloading operation. In addition, the controller 12 may also determine the material state in the hopper 22 of the feeding car 3 according to the image information, and then control the prompting device 14 to output the corresponding prompting information for guidance, such as the prompting information for guidance corresponding to lifting, remaining and lowering of the feeding bin 31.

The pressure detector 16 is provided on the material conveying mechanism 221 of the paver 2 for detecting a conveying pressure of the material conveying mechanism 221. Specifically, the pressure detector 16 is provided in the hydraulic pump of the material conveying mechanism 221 to determine the conveying pressure of the material conveying mechanism 221 by detecting the fluid pressure. The controller 12 is electrically connected with the pressure detector 16 to acquire the detection data of the pressure detector 16, determine the amount of material conveyed by the material conveying mechanism 221 according to the conveying pressure of the material conveying mechanism 221, and then control the prompting device 14 to output prompting information for guidance corresponding to the unloading operation, such as guiding lifting, remaining or lowering of the feeding bin 31 of the feeding car 3, or adjusting the lifting speed of the bin 31.

The lighting device 13 is provided on the paver 2 for providing lighting for the image acquisition area of the image acquisition device 11. When the construction environment is dark or at night, lighting may be provided through the lighting device 13 to reduce the impact of the light on the image information, so that the guide system 7 for feeding car of paver may still operate normally at night or in dark environments such as tunnels, so as to improve the adaptability of the guide system 7 for feeding car of paver and expand the scope of application of the paver 2.

The guide system 7 for feeding car of paver in the embodiment may control the prompting device 14 to output the corresponding prompting information for guidance according to the image information, so as to guide the operation of the driver of the feeding car 3 without manual observation. The efficiency and accuracy of information transmission are higher, which is conducive to improving the efficiency of the feeding car 3 supplying for the hopper 22 of the paver 2, so as to meet the demand of the paver 2 for the continuity of feeding. At the same time, it may effectively reduce the labor intensity of the operator in the construction site and reduce the potential safety hazards.

Figure 26:
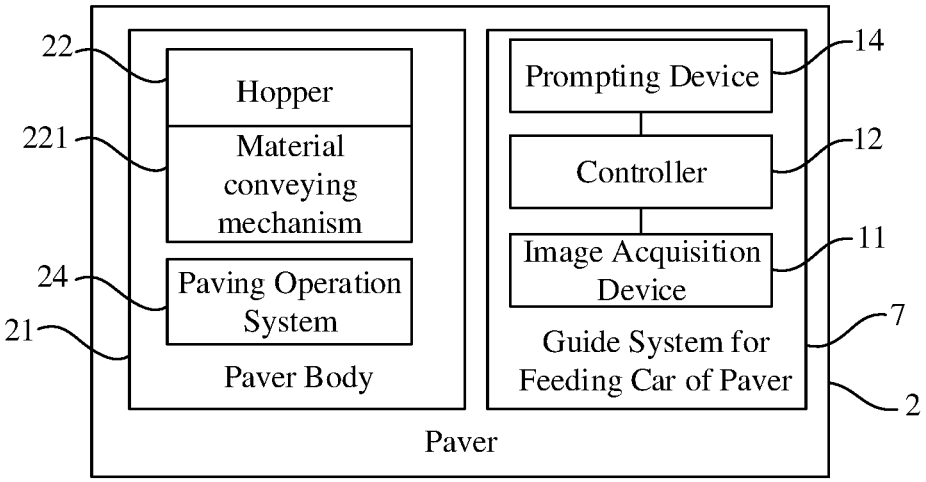
FIG. 26 is a schematic block diagram of a paver according to an embodiment of the present application.

The embodiment provides a paver 2, as shown in FIG. 18 and FIG. 26. The paver 2 includes a paver body 21, a hopper 22, a paving operation system 24 and the guide system 7 for feeding car of paver in any of the above embodiments.

The paver body 21 is used to carry the hopper 22 and the paving operation system 24, and the paving operation is realized through a travelling of the paver body 21. The hopper 22 is provided at a front of the paver body 21 for receiving the materials 5 transported by the feeding car 3. The paving operation system 24 is provided at a tail of the paver body 21 to perform paving operation on the materials. The hopper 22 is provided with a material conveying mechanism 221 along a length direction of the paver body 21, which may convey the material 5 to the paving operation system 24. The image acquisition device 11 and the controller 12 in the guide system 7 for feeding car of paver are provided on the paver body 21, and the prompting device 14 is provided on the feeding car 3. The image acquisition device 11 is provided at the position above the hopper 22 to acquire the image information of the hopper 22 and the feeding car 3. The controller 12 controls the prompting device 14 to output the corresponding prompting information for guidance according to the image information, so as to guide the driver of the feeding car 3, make the feeding car 3 reverse to the unloading position of the hopper 22 in time and accurately, and complete the unloading operation. The paver 2 in the embodiment may effectively improve the accuracy and operation efficiency of the unloading operation of the feeding car 3 and reduce the labor intensity of the operator and the dependence on the operation experience. In addition, the paver 2 in the embodiment also has all the beneficial effects of the guide system 7 for feeding car of paver in any of the above embodiments, which will not be repeated here.

Figure 27:
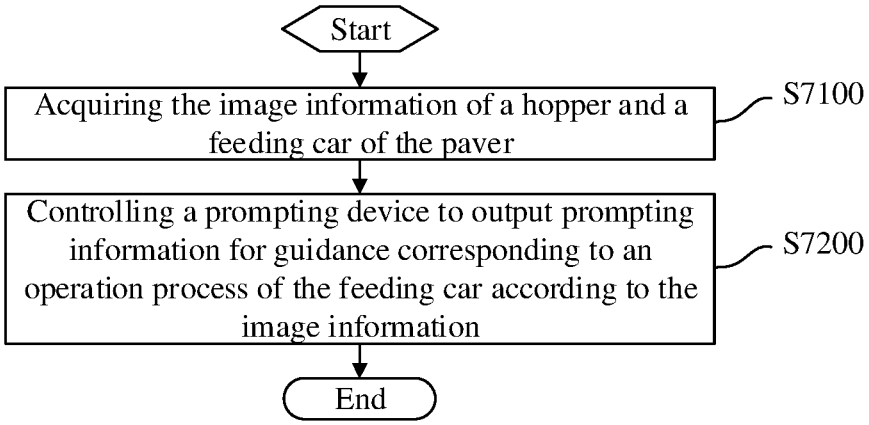
FIG. 27-FIG. 31 are flowcharts of a guide method for feeding car according to an embodiment of the present application.

The embodiment provides a guide method for feeding car of paver, which is applied to the guide system for feeding car of paver in any of the above embodiments. As shown in FIG. 27, the method includes the following method steps.

Step S7100: acquiring the image information of a front end of a hopper of the paver.

Step S7200: controlling a prompting device to output prompting information for guidance corresponding to an operation process of the feeding car according to the image information.

In the embodiment, the image information of the hopper and the feeding car of the paver is acquired to determine a relative position between a tail of the feeding car and the hopper or the material state in the feeding bin 31 of the feeding car according to the image information, so as to determine next operation that the feeding car should perform and control the prompting device to output the prompting information for guidance corresponding to the operation process of the feeding car, which guides the driver of the feeding car to operate according to the prompting information for guidance, making the feeding car reverse to the unloading position of the hopper timely and accurately and carry out the unloading operation.

Figure 28:
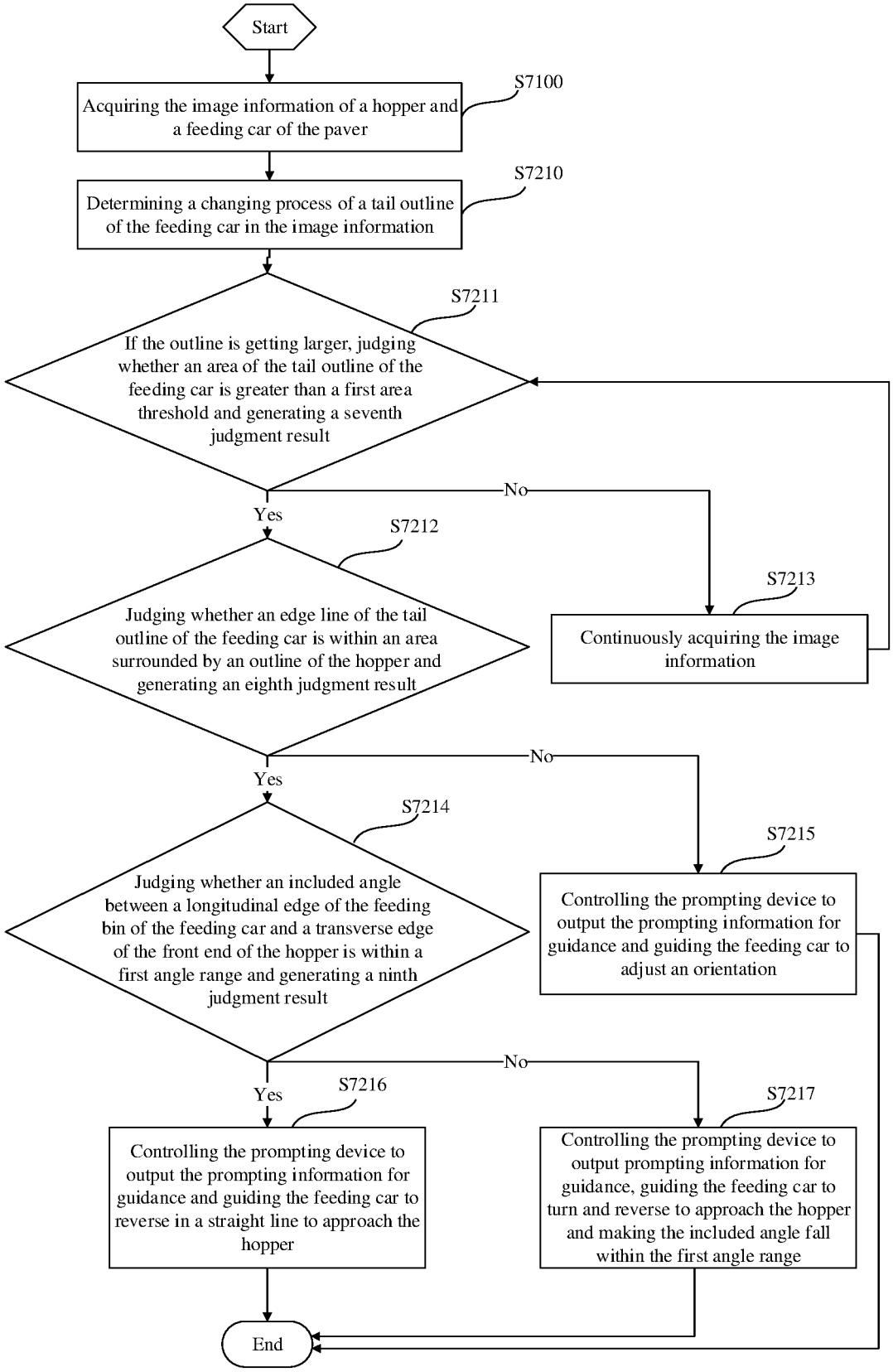

The embodiment provides a guide method for feeding car of paver, which is used for the guide system for feeding car of paver in any of the above embodiments, as shown in FIG. 28, including the following method steps.

Step S7100: acquiring image information of a hopper and a feeding car of the paver.

Step S7210: determining a changing process of a tail outline of the feeding car in the image information.

Step S7211: if the outline is getting larger, judging whether an area of the tail outline of the feeding car is greater than a first area threshold and generating a seventh judgment result.

If the seventh judgment result is yes, executing Step S7212: judging whether an edge line of the tail outline of the feeding car is within an area surrounded by an outline of the hopper and generating an eighth judgment result.

If the seventh judgment result is no, executing Step S7213: continuously acquiring the image information and executing Step S7211.

If the eighth judgment result is yes, executing Step S7214: judging whether an included angle between a longitudinal edge of the feeding bin of the feeding car and a transverse edge of the front end of the hopper is within a first angle range and generating a ninth judgment result.

If the eighth judgment result is no, executing Step S7215: controlling the prompting device to output the prompting information for guidance and guiding the feeding car to adjust an orientation.

If the ninth judgment result is yes, executing Step S7216: controlling the prompting device to output the prompting information for guidance and guiding the feeding car to reverse in a straight line to approach the hopper.

If the ninth judgment result is no, executing Step S7217: controlling the prompting device to output prompting information for guidance, guiding the feeding car to turn and reverse to approach the hopper and making the included angle fall within the first angle range.

In the embodiment, Step S7200 is further improved on the basis of the embodiments mentioned above. Through Step S7210, whether the feeding car is in the process of reversing is determined. In the process of reversing the feeding car to approach the hopper, whether the relative distance between the feeding car and the hopper reaches a preset distance is determined through Step S7211. Within the range of the distance, the feeding car may start further adjustment. Then, through Step S7212, whether the reversing direction of the feeding car matches an opening at the front end of the hopper is determined. If the edge line of the tail outline of the feeding car is outside the area surrounded by the outline line of the hopper, the feeding bin of the feeding car may interfere with the side wall of the hopper during unloading, resulting in some materials unable to fall into the hopper. At this time, the feeding car is guided to adjust the orientation, such as merging operation through Step S7215. Whether a deflection angle of the feeding car relative to the hopper exceeds a normal range is determined through Step S7214. If the included angle between the longitudinal edge of the feeding bin and the transverse edge of the front end of the hopper is within the first angle range, it means that the inclination angle of the feeding car relative to the hopper is small and within the normal range. At this time, through Step S7216, the feeding car is guided to continue to reverse in a straight line to approach the hopper and to approach the unloading position in the current state. Otherwise, it indicates that the deflection angle of the feeding car relative to the hopper is too large. At this time, through Step S7217, the feeding car is guided to conduct steering operation, such as reversing or turning right, to adjust the direction of the feeding car, reduce the included angle between the longitudinal edge of the feeding bin and the transverse edge of the front end of the hopper, and restore the included angle to the first angle range, so that the feeding car may accurately reverse to the unloading position of the hopper. The first angle range may be set according to a specific size of the hopper and the feeding bin.

Figure 29:
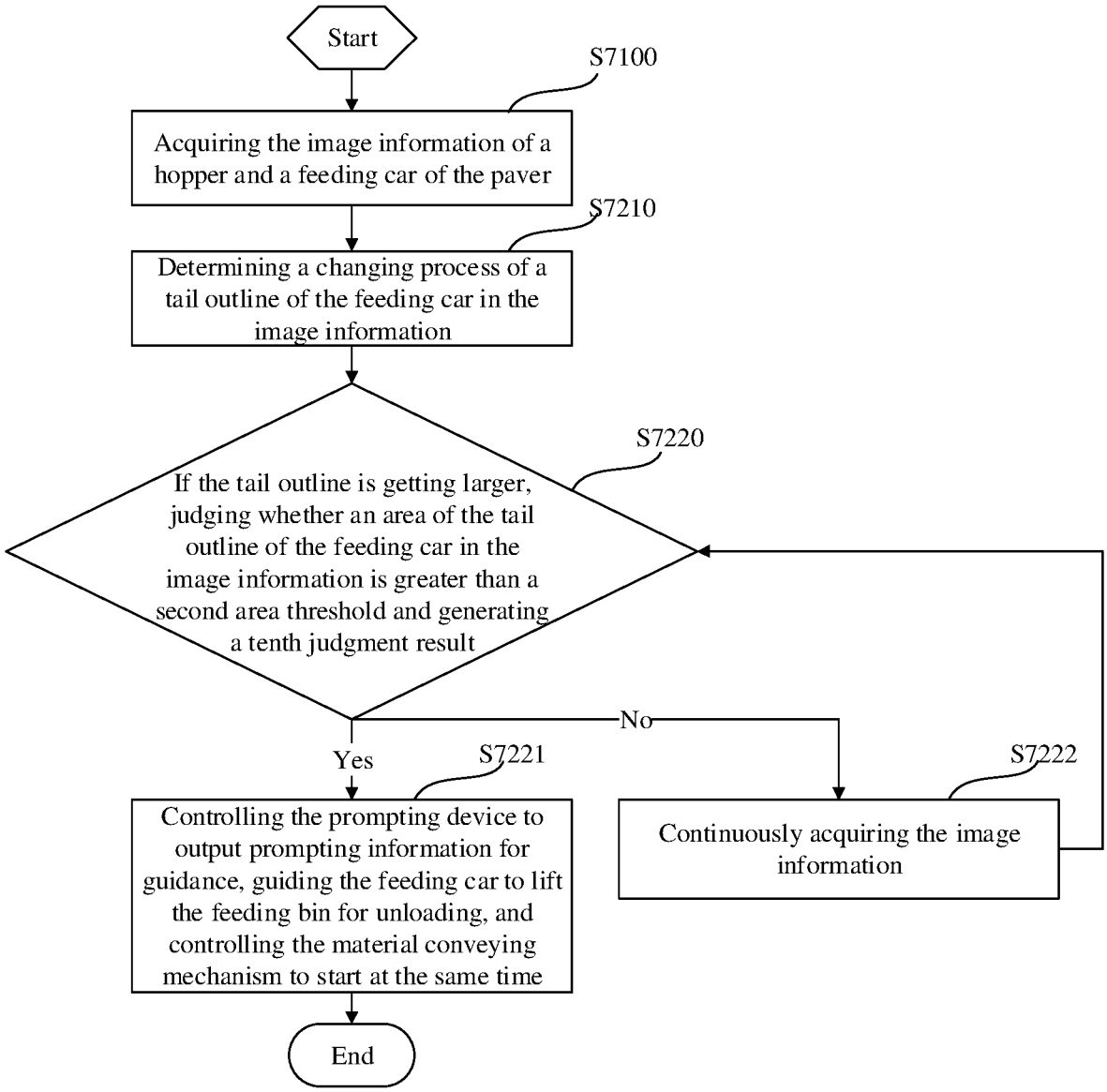

The embodiment provides a guide method for feeding car of paver, which is applied to the guide system for feeding car of paver in any of the above embodiments. As shown in FIG. 29, the method includes the following method steps.

Step S7100: acquiring image information of a hopper and a feeding car of the paver.

Step S7210: determining a changing process of a tail outline of the feeding car in the image information.

Step S7220: if the tail outline is getting larger, judging whether an area of the tail outline of the feeding car in the image information is greater than a second area threshold and generating a tenth judgment result.

If the tenth judgment result is yes, executing Step S7221: controlling the prompting device to output prompting information for guidance, guiding the feeding car to lift the feeding bin for unloading, and controlling the material conveying mechanism to start at the same time.

If the tenth judgment result is no, executing Step S7222: continuously acquiring the image information.

The controller of the guide system for feeding car of paver is electrically connected with the material conveying mechanism of the paver to control an operating state of the material conveying mechanism according to the image information.

In the embodiment, Step S7200 is further improved on the basis of the embodiments mentioned above. Specifically, in the process of reversing the feeding car to approach the hopper, whether the feeding car has reached the unloading position is determined through Step S7220. The second area threshold corresponds to an area of the feeding car at a boundary of the unloading position, which may be set according to a specific size of the hopper and the feeding car. After the feeding car reaches the unloading position, through Step S7221, the prompting device is controlled to output prompting information for guidance to guide the feeding car to lift the feeding bin for unloading operation. At the same time, the material conveying mechanism of the paver is controlled to start transferring the materials received in the hopper to the paving operation system, so as to realize supplying the materials for the paving operation system for paving operation.

Figure 30:
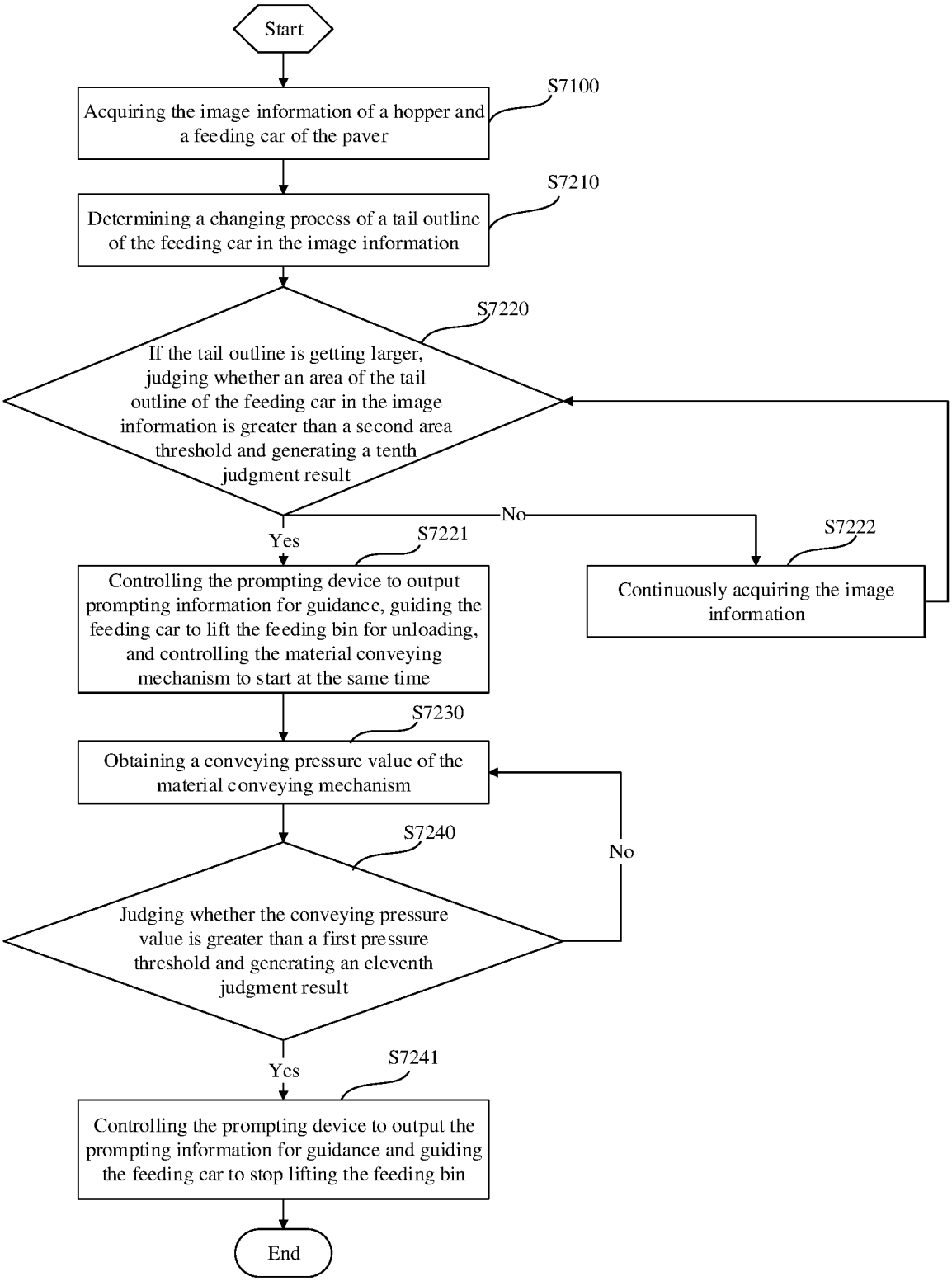

The embodiment provides a guide method for feeding car of paver, which is applied to the guide system for feeding car of paver in any of the above embodiments. As shown in FIG. 30, the method includes the following method steps.

Step S7100: acquiring image information of a hopper and a feeding car of the paver.

Step S7210: determining a changing process of a tail outline of the feeding car in the image information.

Step S7220: if the tail outline is getting larger, judging whether an area of the tail outline of the feeding car in the image information is greater than a second area threshold and generating a tenth judgment result.

If the tenth judgment result is yes, executing Step S7221: controlling the prompting device to output prompting information for guidance, guiding the feeding car to lift the feeding bin for unloading, and controlling the material conveying mechanism to start at the same time.

If the tenth judgment result is no, executing Step S7222: continuously acquiring the image information and executing Step S7220.

Step S7230: obtaining a conveying pressure value of the material conveying mechanism.

Step S7240: judging whether the conveying pressure value is greater than a first pressure threshold and generating an eleventh judgment result.

If the eleventh judgment result is yes, executing Step S7241: controlling the prompting device to output the prompting information for guidance and guiding the feeding car to stop lifting the feeding bin.

If the eleventh judgment result is no, executing Step S7230.

The material conveying mechanism is provided with a pressure detector to detect the conveying pressure of the material conveying mechanism and the controller of the guide system for feeding car of paver is electrically connected with the material conveying mechanism and the pressure detector of the paver.

In the embodiment, Step S7230 to Step S7241 are added to the embodiments mentioned above. Specifically, through Step S7230 and Step S7240, conveying amount of the material conveying mechanism is determined. The larger the conveying pressure value is, the more the conveying amount is. If the conveying pressure value is greater than the first pressure threshold, the prompting device is controlled to output the corresponding prompting information for guidance through Step S7241, and the feeding car is guided to stop lifting the feeding bin, so as to prevent excessive amount of material supplied to the hopper from affecting the paving operation of the paving operation system and also prevent amount of material from exceeding a load of the material conveying mechanism, which is conducive to delaying wear of conveying parts (such as a conveying belt) on the material conveying mechanism and extending service life.

Figure 31:
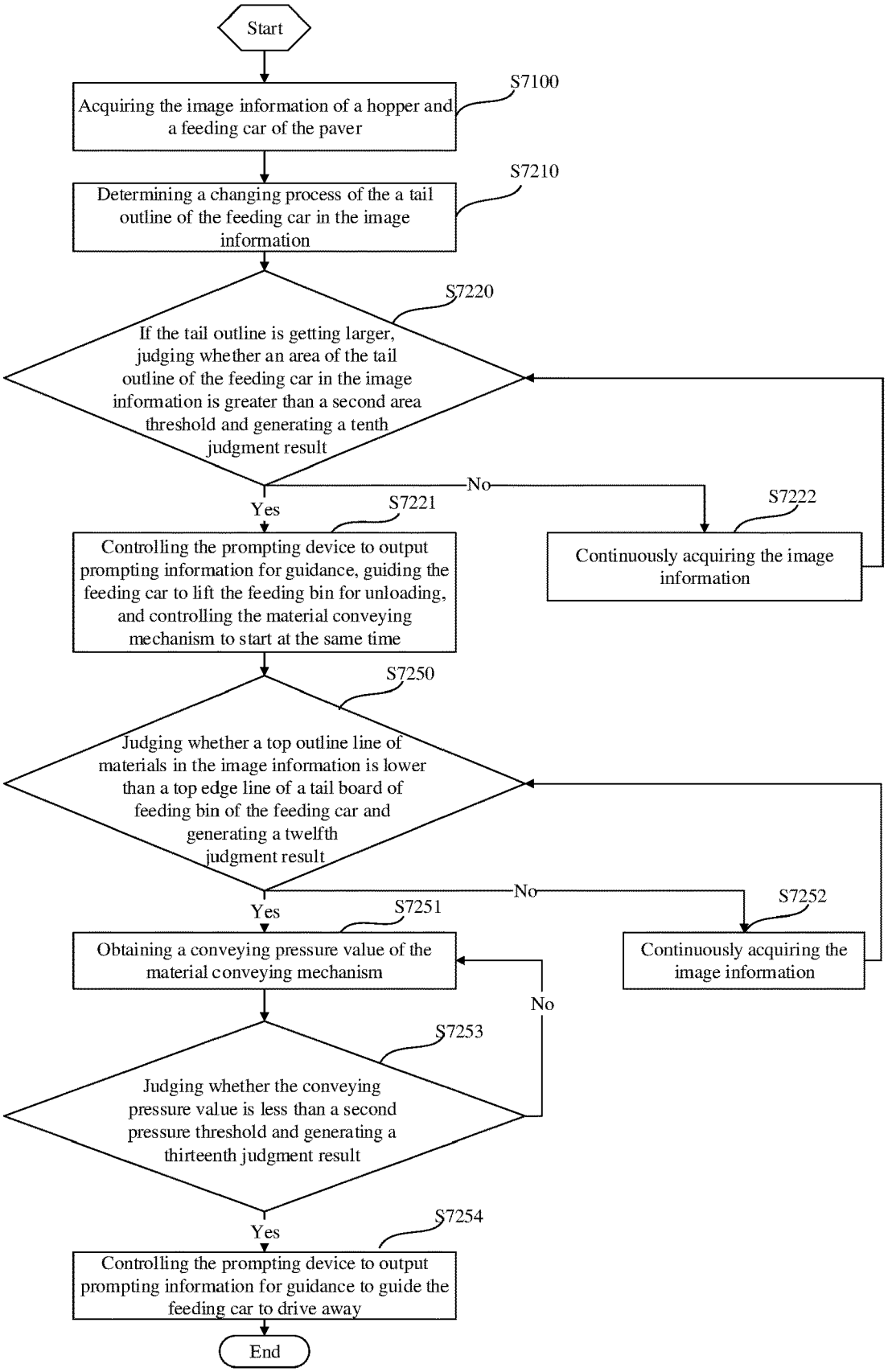

The embodiment provides a guide method for feeding car of paver, which is applied to the guide system for feeding car of paver in any of the above embodiments. As shown in FIG. 31, the method includes the following method steps.

Step S7100: acquiring image information of a hopper and a feeding car of the paver.

Step S7210: determining a changing process of a tail outline of the feeding car in the image information.

Step S7220: if the tail outline is getting larger, judging whether an area of the tail outline of the feeding car in the image information is greater than a second area threshold and generating a tenth judgment result.

If the tenth judgment result is yes, executing Step S7221: controlling the prompting device to output prompting information for guidance, guiding the feeding car to lift the feeding bin for unloading, and controlling the material conveying mechanism to start at the same time.

If the tenth judgment result is no, executing Step S7222: continuously acquiring the image information and executing Step S7220.

Step S7250: judging whether a top outline line of materials in the image information is lower than a top edge line of a tail board of feeding bin of the feeding car and generating a twelfth judgment result.

If the twelfth judgment result is yes, executing Step S7251: obtaining a conveying pressure value of the material conveying mechanism.

If the twelfth judgment result is no, executing Step S7252: continuously acquiring the image information and executing Step S7250.

Step S7253: judging whether the conveying pressure value is less than a second pressure threshold and generating a thirteenth judgment result.

If the thirteenth judgment result is yes, executing Step S7254: controlling the prompting device to output prompting information for guidance to guide the feeding car to drive away.

if the thirteenth judgment result is no, executing Step S7251.

The material conveying mechanism is provided with a pressure detector to detect the conveying pressure of the material conveying mechanism. The controller of the guide system for feeding car of paver is electrically connected with the material conveying mechanism and the pressure detector of the paver.

Figure 21:
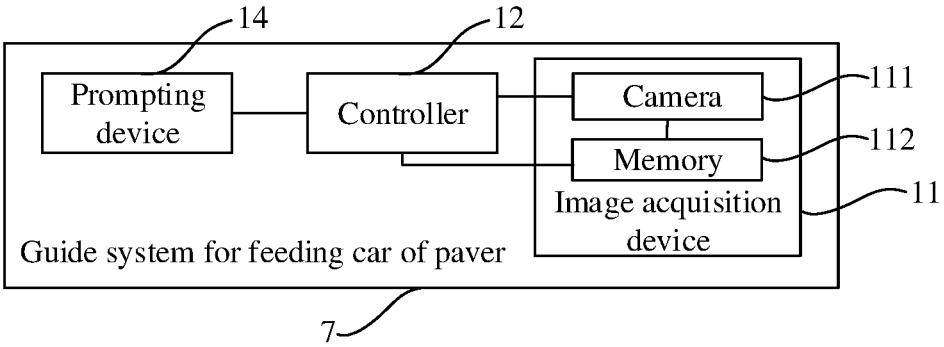
FIG. 21 is a schematic block diagram of a guide system for feeding car of paver according to an embodiment of the present application.

In the embodiment, Step S7250 to Step S7254 are added on the basis of the embodiments mentioned above. As shown in FIG. 21, through Step S7250, whether the materials 5 in the feeding bin 31 has been discharged into the hopper 2 is determined. If the top outline line of material 5 is lower than the top edge line of the tail board of feeding bin 311 of the feeding car 3, it indicates that the materials 5 has been discharged into the hopper 2. Further, through Step S7251 and Step S7253, whether there is a large amount of material accumulation in the material conveying mechanism is determined, so as to further confirm whether the materials in the feeding bin are completely discharged into the hopper. If the conveying pressure value is less than the second pressure threshold, it indicates that there is less material in the material conveying mechanism, that is, the material in the feeding bin has been completely discharged into the hopper, most of the material on the material conveying mechanism has been transferred to the paving operation system, and there is less material at a receiving end of the hopper. At this time, through Step S7254, the prompting device is controlled to output the corresponding prompting information for guidance to guide the feeding car to drive away, so as to facilitate the unloading of a next feeding car.

The technical solutions according to some embodiments of the present application are described in detail above in combination with the attached drawings. The corresponding prompting information for guidance may be output by the prompting device according to the image information to guide the operation of the driver of the feeding car without manual observation. The efficiency and accuracy of information transmission are higher, which is conducive to improving the efficiency of feeding from the feeding car to the hopper of the paver to meet the demand of the paver for the continuity of material supply.

Figure 32:
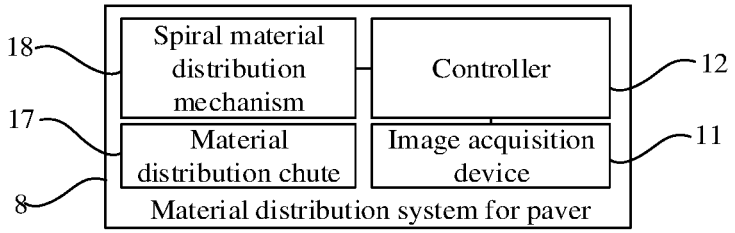
FIG. 32 is a schematic block diagram of a material distribution system for paver according to an embodiment of the present application.
Figure 33:
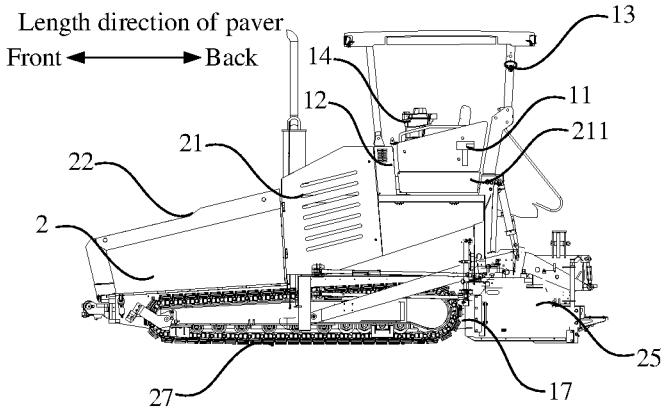
FIG. 33 is a structural diagram of a paver according to an embodiment of the present application.
Figure 34:
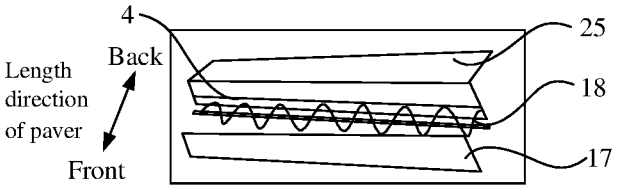
FIG. 34 is an image schematic diagram of a material distribution chute according to an embodiment of the present application.

The embodiment provides a material distribution system 8 for paver, which is applied to the paver 2. As shown in FIG. 32 to FIG. 34, the material distribution system 8 for paver includes a material distribution chute 17, a spiral material distribution mechanism 18, an image acquisition device 11 and a controller 12.

The material distribution chute 17, the spiral material distribution mechanism 18, the image acquisition device 11 and the controller 12 are all provided on the paver 2. The material distribution chute 17 is provided along a width direction of the paver 2 and is connected with a material conveying passage 222 of the paver 2. The materials received by the paver 2 are conveyed to the material distribution chute 17 through the material conveying passage 222. The spiral material distribution mechanism 18 is provided in the material distribution chute 17 along the width direction of the paver 2, so as to drive the materials in the material distribution chute 17 to move along the width direction of the paver 2 through a rotation of the spiral material distribution mechanism 18, and to fill the entire material distribution chute 17 to realize material distribution. The bottom of the material distribution chute 17 is provided with an opening so that the materials in the material distribution chute 17 may be discharged to the road to be paved through the opening and a large width range may be covered for paving operation.

The image acquisition device 11 is provided above the material distribution chute 17 of the paver 2, specifically on the outer side of the cockpit 211. The image acquisition device 11 faces the material distribution chute 17 and is used to acquire the image information at the material distribution chute 17. The controller 12 is electrically connected with the image acquisition device 11 and the spiral material distribution mechanism 18 to determine the material state in the material distribution chute 17 according to the image position of the top edge line 4 of the materials in the image information acquired by the image acquisition device 11, and correspondingly controls an operation of the spiral material distribution mechanism 18 to carry out the corresponding material distribution operation for the material in the material distribution chute 17. The material status includes, but is not limited to, a material height at different positions, an average height and a distribution of the materials in the material distribution chute 17. The controller 12 may control the spiral material distribution mechanism 18 to perform different operations according to the different states of the materials in the material distribution chute 17. For example, when there are a large amount of materials in the middle of the material distribution chute 17, the controller 12 may control the spiral material distribution mechanism 18 to accelerate the rotation to make the materials move towards the two ends of the material distribution chute 17, or when there are few materials in the middle of the material distribution chute 17, the controller 12 may control a reverse rotation of the spiral material distribution mechanism 18 to make the materials at both ends of the material distribution chute 17 backfill to the middle.

The material distribution system 8 for paver in the embodiment determines the different states of the materials in the material distribution chute 17 according to the image information at the material distribution chute 17, and then controls the spiral material distribution mechanism 18 to carry out the corresponding operations. Compared with a scheme of detecting the height of the materials through a level sensor or other sensors, the scheme of the embodiment may obtain more information about the state of the materials, effectively improve the accuracy of the material distribution operation, reduce invalid operations and misoperations, and make the material distribution in the material distribution chute 17 more uniform, which is conducive to improving the paving quality of the paver 2. In addition, in case of abnormal distribution of materials in the material distribution chute 17, no manual operation is required for adjustment, which saves time of adjustment and improves efficiency of material distribution operation.

The material distribution system 8 for paver of the embodiment is further improved on the basis of the embodiments mentioned above.

Figure 35:
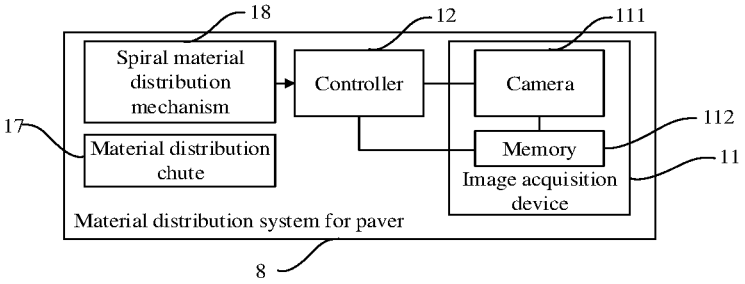
FIG. 35-FIG. 37 are schematic block diagrams of a material distribution system for paver according to an embodiment of the present application.

As shown in FIG. 33 to FIG. 35, a camera 111 is located above a material distribution chute 17, specifically on the outer side of a cockpit 211. The camera 111 faces the direction of the material distribution chute 17 and only one camera 111 is used to acquire the overall image of all materials in the material distribution chute 17. The image acquisition efficiency is higher and the camera 111 is not easy to be blocked. The memory 112 is electrically connected with the camera 111 to store the image information acquired by the camera 111 and the reference image information. The reference image information is used to record the image positions of the materials in the material distribution chute 17 at different heights for reference.

The controller 12 may retrieve the image information and the reference image information in the memory 112, determine the material state in the material distribution chute 17 by comparing the image position of the material in the image information with the image position of the material in the reference image information, and then perform the corresponding control operation on the spiral material distribution mechanism 18 for material distribution. The material status includes, but is not limited to, a material height at different positions, an average height and a distribution of the materials in the material distribution chute 17.

In the embodiment, the material distribution system 8 for paver takes the reference image information as reference for determining the material status in the material distribution chute 17. The judgment basis is more diverse and more comprehensive, the judgment result of the material status is more accurate and the control operation of the spiral material distribution mechanism 18 is more targeted, which is conducive to reducing invalid operations and misoperations, and improving quality and efficiency of the paving operation.

The material distribution system 8 for paver of the embodiment is further improved on the basis of the embodiments mentioned above.

Figure 36:
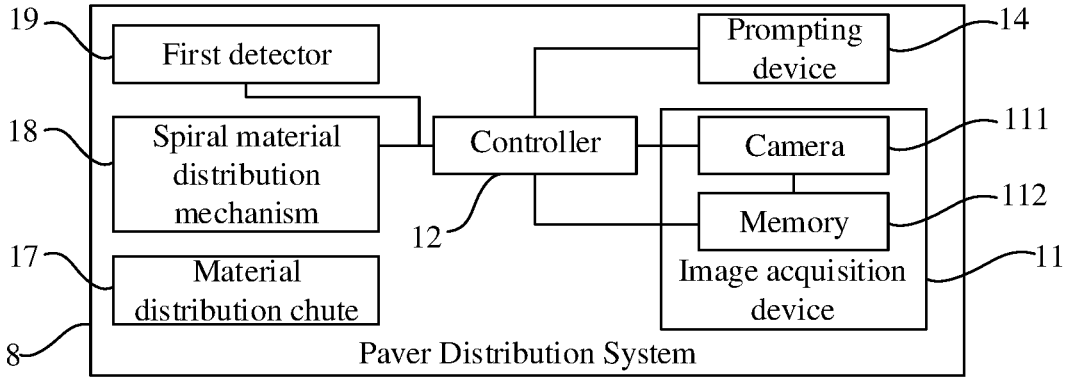

As shown in FIG. 33, FIG. 34 and FIG. 36, the material distribution system 8 for paver also includes a first detector 19 and a prompting device 14. The first detector 19 is provided in the material conveying passage 222 of the paver 2 to detect the height of the material in the material conveying passage 222. The controller 12 is electrically connected with the first detector 19. The controller 12 receives detection data of the first detector 19, determines conveying amount of materials in the material conveying passage 222 according to the detection data of the first detector 19, and then controls the spiral material distribution mechanism 18 to perform corresponding operations. The first detector 19 may be a level sensor, and a number of the first detector 19 may be one or more.

The prompting device 14 is provided on the paver 2, specifically in the cockpit 211 of the paver 2, and is used to output prompting information. The controller 12 is electrically connected with the prompting device 14. The controller 12 determines the amount of material conveyed to the material distribution chute 17 through the material conveying passage 222 according to the detection data of the first detector 19, and then controls the operating state of the prompting device 14 so that the prompting device 14 outputs the prompting information corresponding to the amount of material.

For example, when the height of the materials in the material conveying passage 222 is low, that is, when the amount of material conveyed to the material distribution chute 17 through the material conveying passage 222 is small, the controller 12 controls the prompting device 14 to output the prompting information corresponding to insufficient material conveying, so as to remind the operator to take corresponding measures in time to supply the materials to the material distribution chute 17, so as to prevent the paver 2 from lacking material during the paving operation and affecting the quality of paving operation.

Further, the controller 12 is also electrically connected with the traveling mechanism 27 of the paver 2. If the material height in the material conveying passage 222 still does not rise within a period of time after the prompting device 14 outputting the prompting information, it is determined that the paver 2 is in a state of material shortage. At this time, the controller 12 controls the travelling mechanism 27 of the paver 2 to stop travelling, that is, to suspend the paving operation, so as to prevent the paver 2 from continuing to travel in the state of material shortage, resulting in suspension of the road paving.

The material distribution system 8 for paver of the embodiment is further improved on the basis of the embodiments mentioned above.

Figure 37:
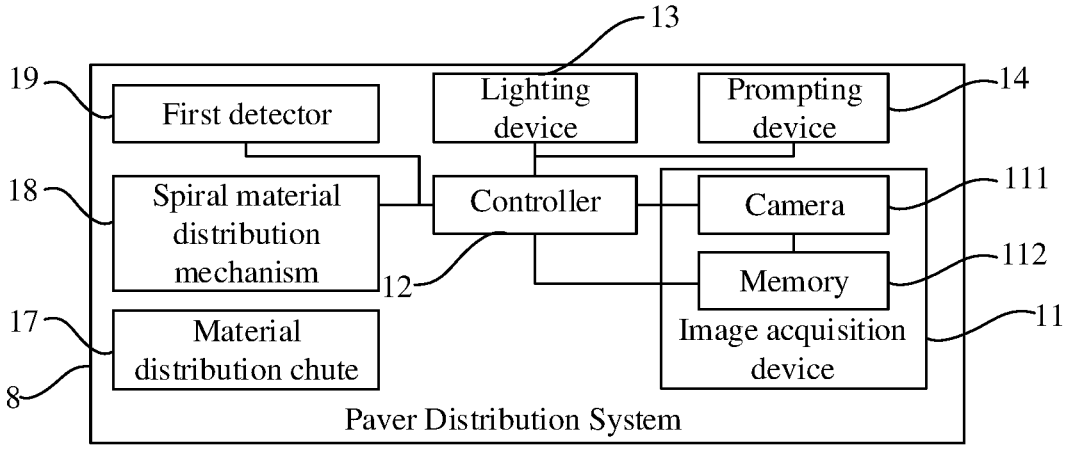

As shown in FIG. 33, FIG. 34 and FIG. 37, the material distribution system 8 for paver also includes a lighting device 13, which is provided on the paver 2, specifically on the outer side of the cockpit 211 of the paver 2 and opposite to the material distribution chute 17, so as to provide lighting for the camera 111 through the lighting device 13 when the light in the construction environment is dark, reducing the impact of light on the image information. Thus the material distribution system 8 for paver may still operate normally at night or in dark environment such as tunnel, which improves adaptability of paver 2 and enlarges scope of paver 2.

It should be noted that the setting position of the lighting device 13 is not limited to the position in FIG. 33, but may also be set on the camera 111 to make an angle of light consistent with a lens angle of the camera 111, which is conducive to further reducing the impact of light on image acquisition.

The embodiment provides a material distribution system 8 for paver, which is applied to the paver 2. As shown in FIG. 33, FIG. 34 and FIG. 37, the material distribution system 8 for paver includes a material distribution chute 17, a spiral material distribution mechanism 18, an image acquisition device 11, a controller 12, a first detector 19, a prompting device 14 and a lighting device 13.

The material distribution chute 17, the spiral material distribution mechanism 18, the image acquisition device 11, the controller 12, the first detector 19, the prompting device 14 and the lighting device 13 are all provided on the paver 2. The material distribution chute 17 is provided along a width direction of the paver 2 and is connected with a material conveying passage 222 of the paver 2. The materials received by the paver 2 are conveyed to the material distribution chute 17 through the material conveying passage 222. The spiral material distribution mechanism 18 is provided in the material distribution chute 17 along the width direction of the paver 2, so as to drive the materials in the material distribution chute 17 to move along the width direction of the paver 2 through a rotation of the spiral material distribution mechanism 18, and to fill the entire material distribution chute 17 to realize material distribution. The bottom of the material distribution chute 17 is provided with an opening so that the materials in the material distribution chute 17 may be discharged to the road to be paved through the opening and a large width range may be covered for paving operation. The first detector 19 is provided in the material conveying passage 222 of the paver 2 to detect the height of the material in the material conveying passage 222.

The camera 111 is provided above the material distribution chute 17, specifically on the outer side of the cockpit 211 and the camera 111 faces the direction of the material distribution chute 17. Only one camera 111 is used to acquire the overall image of all materials in the material distribution chute 17. The image acquisition efficiency is higher and the camera 111 is not easy to be blocked. The memory 112 is electrically connected with the camera 111 to store the image information acquired by the camera 111 and the reference image information. The reference image information is used to record the image positions of the materials in the material distribution chute 17 at different heights for reference. The lighting device 13 is provided on the outer side of the cockpit 211 of the paver 2 and is opposite to the material distribution chute 17 to provide lighting for the camera 111 when the light in the construction environment is dark, so as to reduce the impact of the light on the image information.

The controller 12 is electrically connected with the camera 111, the memory 112 and the spiral material distribution mechanism 18 to control the operation of the camera 111, the memory 112 and the spiral material distribution mechanism 18. The controller 12 may retrieve the image information and the reference image information in the memory 112, determine the material state in the material distribution chute 17 by comparing the image position of the material in the image information with the image position of the material in the reference image information, and then perform the corresponding control operation on the spiral material distribution mechanism 18 for material distribution. The material status includes, but is not limited to, a material height at different positions, an average height and a distribution of the materials in the material distribution chute 17. The controller 12 may control the spiral material distribution mechanism 18 to perform different operations according to the different states of the materials in the material distribution chute 17. For example, when there are a large amount of materials in the middle of the material distribution chute 17, the controller 12 may control the spiral material distribution mechanism 18 to accelerate the rotation to make the materials move towards the two ends of the material distribution chute 17, or when there are few materials in the middle of the material distribution chute 17, the controller 12 may control a reverse rotation of the spiral material distribution mechanism 18 to make the materials at both ends of the material distribution chute 17 backfill to the middle. The controller 12 may also determine conveying amount of material in the material conveying passage 222 according to the detection data of the first detector 19, control the spiral material distribution mechanism 18 to increase a rotating speed when the conveying amount of material in the material conveying passage 222 is large and control the spiral material distribution mechanism 18 to reduce the rotating speed when the conveying amount of material in the material conveying passage 222 is small, so as to adjust a material distributing speed.

The prompting device 14 is provided in the cockpit 211 of the paver 2 for outputting prompt information. The controller 12 is electrically connected with the prompting device 14, and determines the amount of material conveyed to the material distribution chute 17 through the material conveying passage 222 according to the detection data of the first detector 19, and then controls the prompting device 14 to output the prompting information corresponding to the amount of material. For example, when the height of the materials in the material conveying passage 222 is low, that is, when the amount of material conveyed to the material distribution chute 17 through the material conveying passage 222 is small, the controller 12 controls the prompting device 14 to output the prompting information corresponding to insufficient material conveying, so as to remind the operator to take corresponding measures in time to supply the materials to the material distribution chute 17. The controller 12 is also electrically connected with the traveling mechanism 27 of the paver 2. If the material height in the material conveying passage 222 still does not rise within a period of time after the prompting device 14 outputting the prompting information, it is determined that the paver 2 is in a state of material shortage. At this time, the controller 12 controls the traveling mechanism 27 of the paver 2 to stop travelling, that is, to suspend the paving operation, so as to prevent the paver 2 from continuing to travel in the state of material shortage, resulting in suspension of the road paving.

Figure 38:
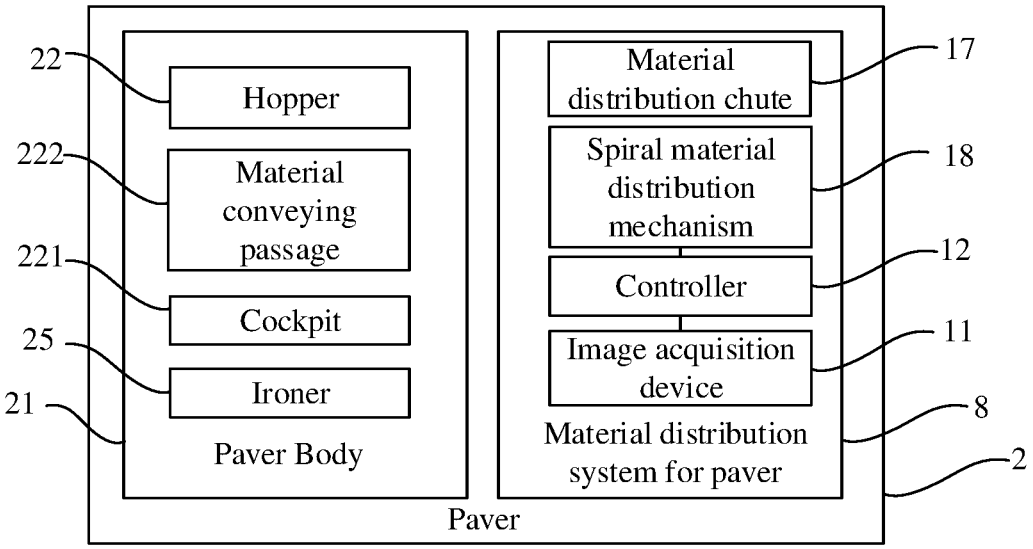
FIG. 38 is a schematic block diagram of a paver according to an embodiment of the present application.

The material distribution system 8 for paver in the embodiment determines different states of the materials in the material distribution chute 17 according to the image information at the material distribution chute 17, and then controls the spiral material distribution mechanism 18 to perform the corresponding operations. Compared with a scheme of detecting the height of the materials through a level sensor or other sensors, the judgment basis of the embodiment is more diverse and more comprehensive, more material state information may be obtained, and the judgment result of the material state is more accurate, which may effectively improve the accuracy of the material distribution operation, make the material distribution in the material distribution chute 17 more uniform and is conducive to improving the paving quality and operation efficiency of the paver 2. In addition, in case of abnormal distribution of materials in the material distribution chute 17, no manual operation is required for adjustment, which saves time of adjustment and improves efficiency of distribution operation The embodiment provides a paver 2, as shown in FIG. 33 and FIG. 38. The paver 2 includes a paver body 21, a hopper 22, an ironer 25 and a material distribution system 8 for paver of any of the above embodiments.

As a main structure of paver 2, the paver body 21 is used for travelling and carrying various operating systems. The hopper 22 is provided at the front of the paver body 21 for receiving materials. The hopper 22 is provided with a material conveying passage 222 along the length direction of the paver body 21. The material conveying mechanism 221 is provided in the material conveying passage 222 for conveying materials. The ironer 25 is provided at the tail of the paver body 21 for performing paving and ironing operations. The material distribution chute 17 in the material distribution system 8 for paver is provided between the material conveying passage 222 and the ironer 25. The material conveying mechanism 221 conveys the materials in the hopper 22 to the material distribution chute 17 through the material conveying passage 222. The materials in the material distribution chute 17 move along the width direction of the paver body 21 under an action of the spiral material distribution mechanism 18 in the material distribution system 8 for paver, fill the material distribution chute 17 and then are discharged from the opening at the bottom of the material distribution chute 17 to a road to be paved. With the travelling of the paver body 21, the ironer 25 paves and irons materials on the road to be paved to realize the paving operation.

The image acquisition device 11 and the controller 12 in the material distribution system 8 for paver are provided on the paver body 21. The image acquisition device 11 is provided above the material distribution chute 17 and opposite to the material distribution chute 17 to facilitate the acquisition of image information at the material distribution chute 17. The controller 12 determines the state of the material in the material distribution chute 17 according to the image information, and then controls the spiral material distribution mechanism 18 to perform corresponding operations to achieve uniform material distribution. The material status includes, but is not limited to, a material height at different positions, an average height and the distribution of the materials in the material distribution chute 17.

The paver 2 in the embodiment may effectively improve the accuracy of the material distribution operation, make the material distribution in the material distribution chute 17 more uniform, and is conducive to improving the paving quality and operation efficiency of the paver 2. In addition, the paver 2 in the embodiment also has all the beneficial effects of the material distribution system 8 for paver of any one of the above embodiments, which will not be repeated here.

Figure 39:
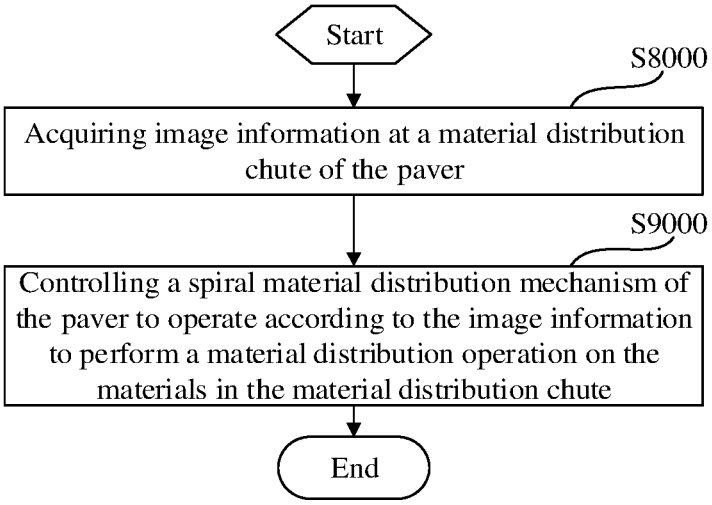
FIG. 39-FIG. 43 are flowcharts of a control method for distributing material of paver according to an embodiment of the present application.

The embodiment provides a control method for distributing material of paver which is applied to the pavers in any of the above embodiments. As shown in FIG. 39, the method includes the following method steps.

Step S8000: acquiring image information at a material distribution chute of the paver.

Step S9000: controlling a spiral material distribution mechanism of the paver to operate according to the image information to perform a material distribution operation on the materials in the material distribution chute.

In the embodiment, through Step S8000 and Step S9000, according to the image information at the material distribution chute of the paver, the material state in the material distribution chute is determined, and then according to the different material states in the material distribution chute, the spiral material distribution mechanism of the paver is controlled to perform the corresponding material distribution operation, so that the materials in the material distribution chute are filled in the material distribution chute. Compared with a scheme of detecting the height of the materials through a level sensor or other sensors, the control method for distributing material of paver in the embodiment may obtain more information about the state of the materials, effectively improve the accuracy of the material distribution operation, reduce invalid operations and misoperations and improve the uniformity of materials in the material distribution chute. Without manual adjustment operation, the accuracy and efficiency of the material distribution operation are higher, which is conducive to improving quality and efficiency of the paving operation.

Figure 40:
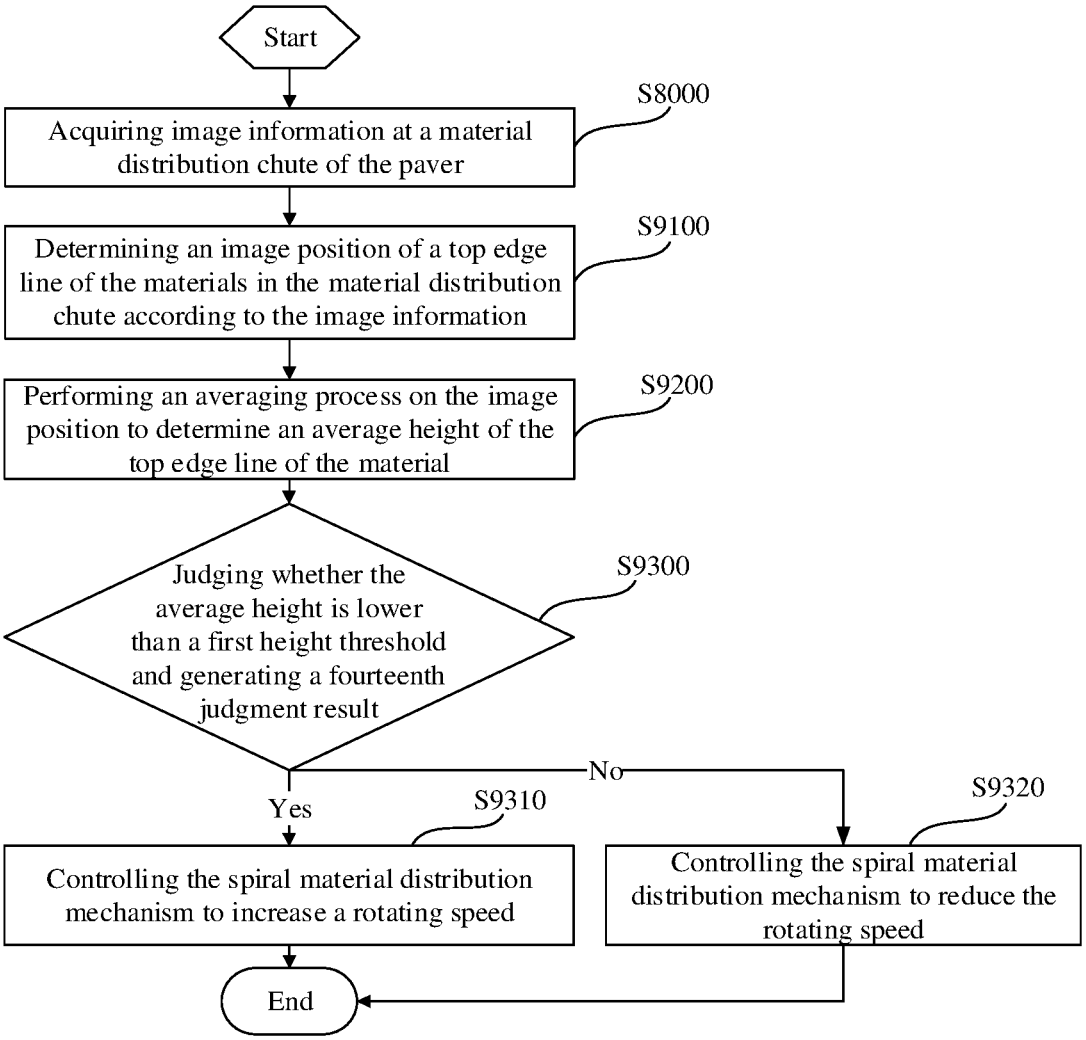

The embodiment provides a control method for distributing material of paver, which is applied to the paver in any of the above embodiments. As shown in FIG. 40, the method includes the following method steps.

Step S8000: acquiring image information at a material distribution chute of the paver.

Step S9100: determining an image position of a top edge line of the materials in the material distribution chute according to the image information.

Step S9200: performing an averaging process on the image position to determine an average height of the top edge line of the material.

Step S9300: judging whether the average height is lower than a first height threshold and generating a fourteenth judgment result.

If the fourteenth judgment result is yes, executing Step S9310: controlling the spiral material distribution mechanism to increase a rotating speed.

If the fourteenth judgment result is no, executing Step S9320: controlling the spiral material distribution mechanism to reduce the rotating speed.

The control method for distributing material of paver in the embodiment is further improved on Step S9000 on the basis of the embodiments mentioned above. Through Step S9100 and Step S9200, the average height of the top edge line of the materials is determined, and then through Step S9300, a size relationship between the average height and the fourteenth height threshold is compared and total amount of materials in the material distribution chute is determined, so as to take different material distribution operations according to the total amount of materials in the material distribution chute. The first height threshold is a critical value of the material height in the material distribution chute. If it is lower than the first height threshold, it indicates that the materials in the material distribution chute is insufficient. Otherwise, it indicates that the material in the material distribution chute is sufficient. According to the fourteenth judgment result of Step S9300, when the fourteenth judgment result is yes, the rotating speed is increased by controlling the spiral material distribution mechanism to speed up a material distributing speed; when the fourteenth judgment result is no, the spiral material distribution mechanism is controlled to reduce the rotating speed to slow down the material distributing speed to prevent material shortage.

Figure 41:
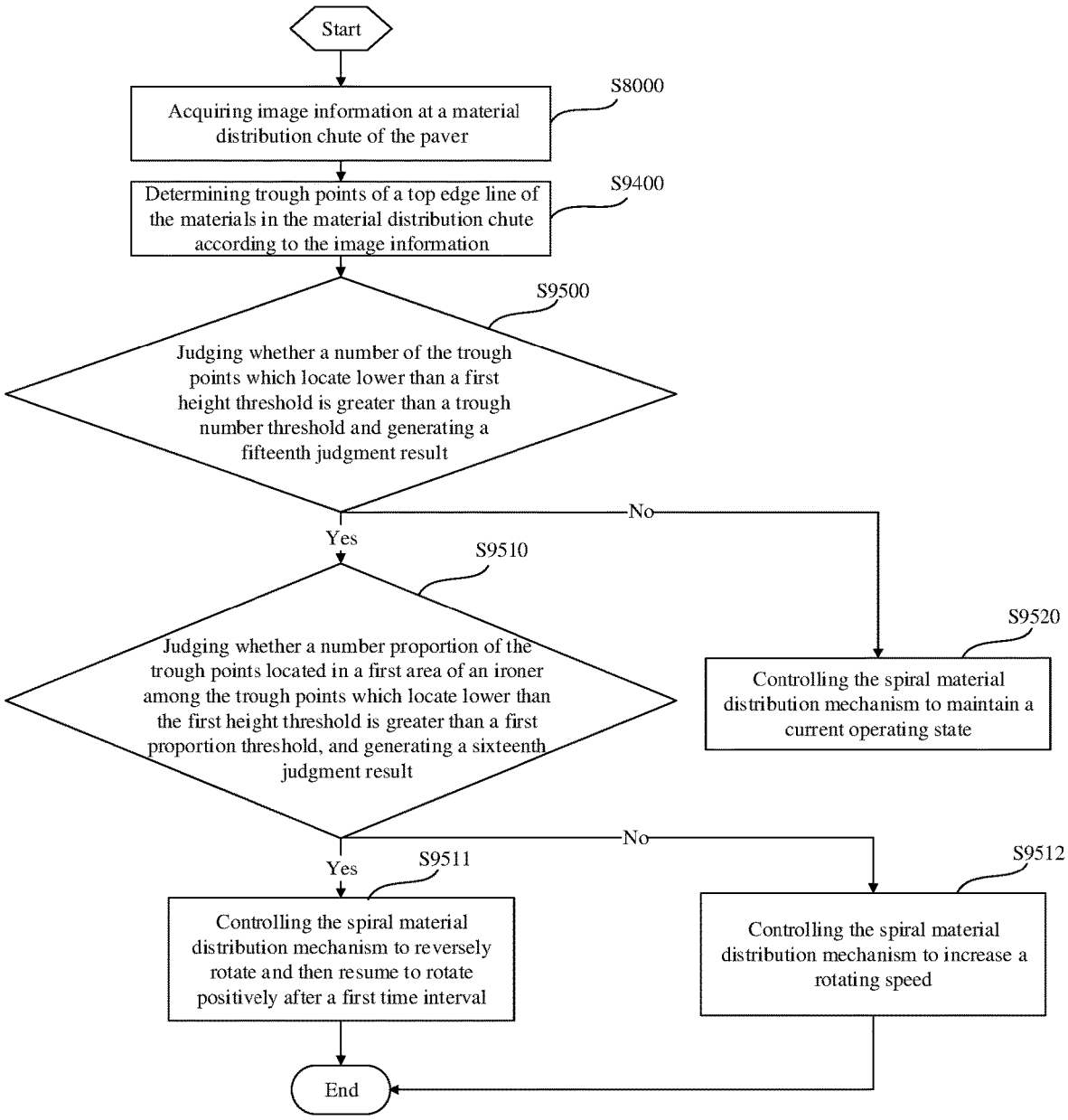

The embodiment provides a control method for distributing material of paver, which is applied to the paver in any of the above embodiments. As shown in FIG. 41, the method includes the following method steps.

Step S8000: acquiring image information at a material distribution chute of the paver.

Step S9400: determining trough points of a top edge line of the materials in the material distribution chute according to the image information.

Step S9500: judging whether a number of the trough points which locate lower than a first height threshold is greater than a trough number threshold and generating a fifteenth judgment result.

If the fifteenth judgment result is yes, executing Step S9510: judging whether a number proportion of the trough points located in a first area of an ironer among the trough points which locate lower than the first height threshold is greater than a first proportion threshold, and generating a sixteenth judgment result.

If the sixteenth judgment result is yes, executing Step S9511: controlling the spiral material distribution mechanism to reversely rotate and then resume to rotate positively after a first time interval.

If the sixteenth judgment result is no, executing Step S9512: controlling the spiral material distribution mechanism to increase a rotating speed.

If the fifteenth judgment result is no, executing Step S9520: controlling the spiral material distribution mechanism to maintain a current operating state.

The first area is an area in a middle of the main section of the ironer and a width of the first area accounts for a preset proportion of the total width of the main section.

The control method for distributing material of paver in the embodiment further improves Step S9000 on the basis of the embodiments mentioned above. Through Step S9400, the trough points of the top edge line of the material in the material distribution chute are determined as the basis for determining a top fluctuation state of the materials. Through Step S9500, a downward depression degree of a top surface of the materials in the material distribution chute is determined and the fifteenth judgment result is generated. If the fifteenth judgment result is yes, it indicates that the downward depression degree of the top surface of the materials is serious, that is, there are many low-lying places, uniformity of the material distribution in the material distribution chute is low and the paving operation quality is greatly affected. Otherwise, it means that the material distribution in the material distribution chute is relatively uniform. At this time, the spiral material distribution mechanism may operate according to the current operating state. When the fifteenth judgment result is yes, overall distribution position of the low-lying places of the materials in the material distribution chute is further determined through Step S9510 and the sixteenth judgment result is generated. If the sixteenth judgment result is yes, it indicates that the low-lying places are concentrated in the middle of the material distribution chute. Through Step S9511, the reverse rotation of the spiral material distribution mechanism is controlled to make the materials in the material distribution chute move in the opposite direction, so that the low-lying places in the middle of the materials at both ends of the material distribution chute are filled and leveled, so as to improve the uniformity of material distribution. After the first time interval, the spiral material distribution mechanism is controlled to resume the positive rotation to resume the normal material distribution operation. If the sixteenth judgment result is no, it indicates that the low-lying places are relatively concentrated near the two ends of the material distribution chute. Through Step S9512, the spiral material distribution mechanism is controlled to increase the rotation speed to speed up the movement of the materials in the middle of the material distribution chute to the positions near the two ends, so as to fill the low-lying places and improve the uniformity of the materials in the material distribution chute. The first height threshold, the trough number threshold, the first proportion threshold and the first time interval may be set according to a specific model and size of the material distribution chute and the spiral material distribution mechanism. The first area is an area located in a middle of the main section of the ironer and a width of the first area accounts for a preset proportion of the total width of the main section. The preset proportion may range from ⅓ to ⅔.

Figure 42:
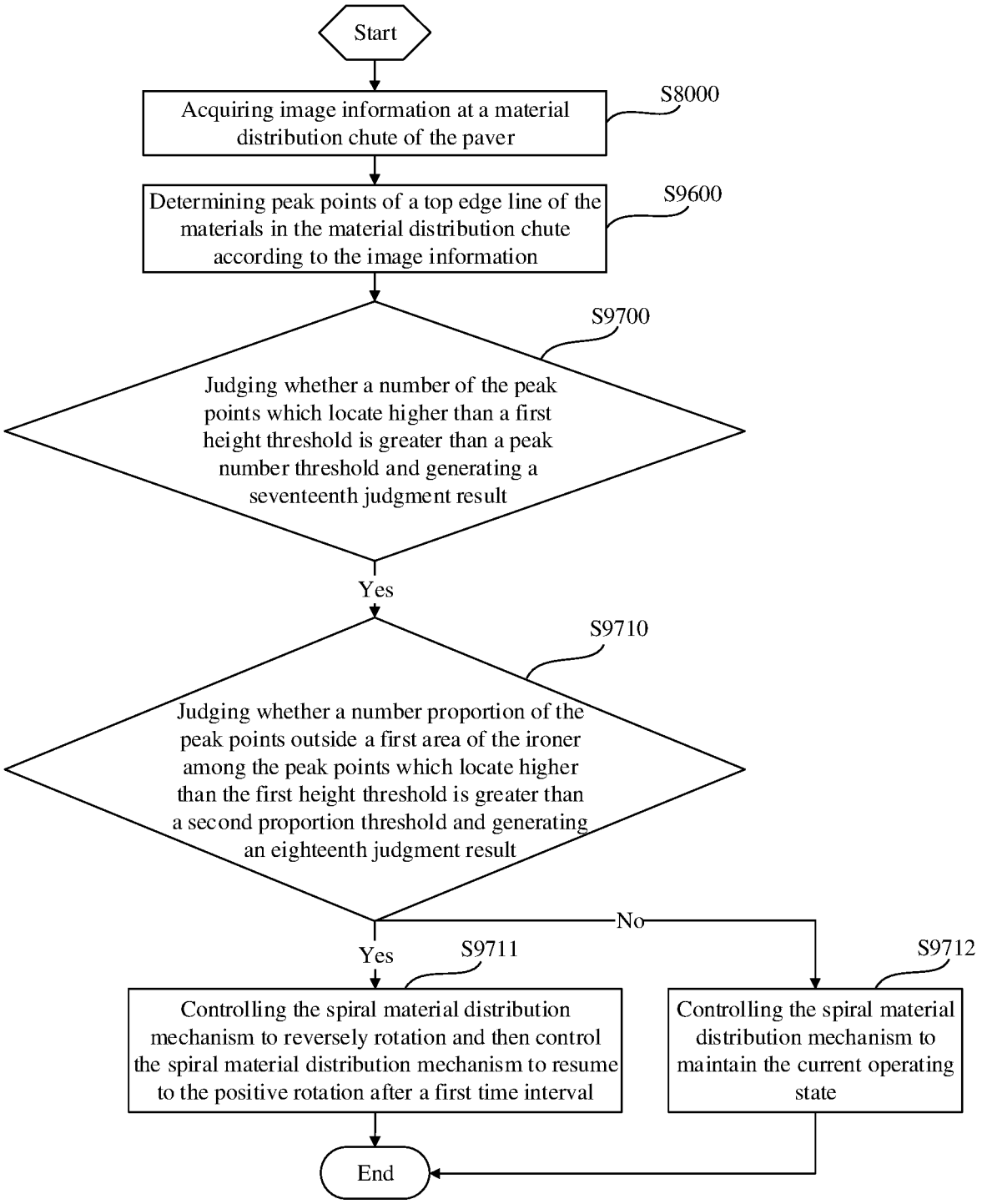

The embodiment provides a control method for distributing material of paver in any of the above embodiments. As shown in FIG. 42, the method includes the following method steps.

Step S8000: acquiring image information at a material distribution chute of the paver.

Step S9600: determining peak points of a top edge line of the materials in the material distribution chute according to the image information.

Step S9700: judging whether a number of the peak points which locate higher than a first height threshold is greater than a peak number threshold and generating a seventeenth judgment result.

If the seventeenth judgment result is yes, executing Step S9710: judging whether a number proportion of the peak points outside a first area of the ironer among the peak points which locate higher than the first height threshold is greater than a second proportion threshold and generating an eighteenth judgment result.

If the eighteenth judgment result is yes, executing Step S9711: controlling the spiral material distribution mechanism to reversely rotation and then control the spiral material distribution mechanism to resume to the positive rotation after a first time interval.

If the eighteenth judgment result is no, executing Step S9712: controlling the spiral material distribution mechanism to maintain the current operating state.

If the seventeenth judgment result is no, executing Step S9712.

The first area is an area located in a middle of the main section of the ironer and whose width accounts for a preset proportion of the total width of the main section.

The control method for distributing material of paver in the embodiment is further improved on Step S9000 on the basis of the embodiments mentioned above. Through Step S9600, the peak points of the top edge line of the materials in the material distribution chute are determined as the basis for determining a top fluctuation state of the materials. Through Step S9700, a bulge state of the materials in the material distribution chute is determined and the seventeenth judgment result is generated. If the seventeenth judgment result is no, it indicates that the bulge of the materials is within an acceptable range, and the spiral material distribution mechanism may keep the current operating state. If the seventeenth judgment result is yes, it indicates that the bulge of the materials is serious. At this time, the distribution of peak points is further determined through Step S9710 and the eighteenth judgment result is generated. If the eighteenth judgment result is yes, it indicates that the peak points higher than the first height threshold are relatively concentrated near the two ends of the material distribution chute. At this time, through Step S9711, the reverse rotation of the spiral material distribution mechanism is controlled to drive the materials near the two ends of the material distribution chute to move towards the middle, so as to reduce the height of the materials near the two ends of the material distribution chute, so as to improve the overall uniformity of the materials in the material distribution chute. After the first time interval, the spiral material distribution mechanism is controlled to resume the positive rotation, so as to resume the normal material distribution operation. If the eighteenth judgment result is no, it indicates that the peak points is relatively concentrated in the middle of the material distribution chute. At this time, control the spiral material distribution mechanism to maintain the current positive rotation state. Normal material distribution operation may make the materials in the middle of the material distribution chute move to both ends. The first height threshold, the peak number threshold, the second proportion threshold and the first time interval may be set according to a specific model and size of the material distribution chute and the spiral material distribution mechanism. The first area is an area located in a middle of the main section of the ironer and a width of the first area accounts for a preset proportion of the total width of the main section. The preset proportion may range from ⅓ to ⅔.

Figure 43:
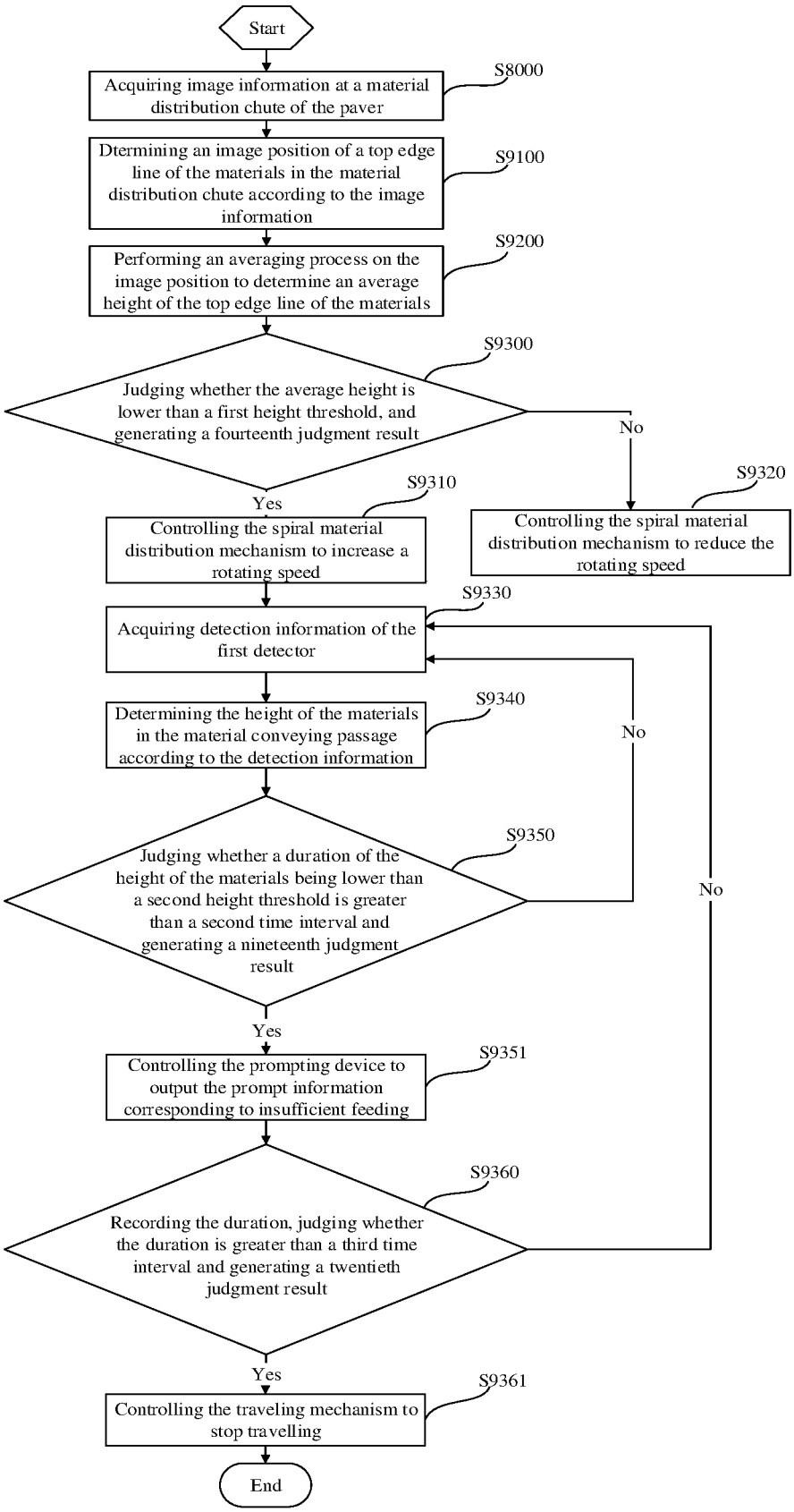

The embodiment provides a control method for distributing material of paver, which is applied to the paver in any of the above embodiments. A first detector for detecting a height of the materials is provided in a material conveying passage of the paver, and a prompting device for outputting prompting information is also provided on the paver. The controller of the paver is electrically connected with the first detector, the prompting device and the traveling mechanism of the paver. As shown in FIG. 43, the control method for distributing material of paver includes the following method steps.

Step S8000: acquiring image information at a material distribution chute of the paver.

Step S9100: determining an image position of a top edge line of the materials in the material distribution chute according to the image information.

Step S9200: performing an averaging process on the image position to determine an average height of the top edge line of the materials.

Step S9300: judging whether the average height is lower than a first height threshold, and generating a fourteenth judgment result.

If the fourteenth judgment result is yes, executing Step S9310: controlling the spiral material distribution mechanism to increase a rotating speed.

Step S9330: acquiring detection information of the first detector.

Step S9340: determining the height of the materials in the material conveying passage according to the detection information.

Step S9350: judging whether a duration of the height of the materials being lower than a second height threshold is greater than a second time interval and generating a nineteenth judgment result.

If the nineteenth judgment result is yes, executing Step S9351: controlling the prompting device to output the prompt information corresponding to insufficient feeding.

If the nineteenth judgment result is no, executing Step S9330.

Step S9360: recording the duration, judging whether the duration is greater than a third time interval and generating a twentieth judgment result.

If the twentieth judgment result is yes, executing Step S9361: controlling the traveling mechanism to stop travelling.

If the twentieth judgment result is no, executing Step S9330.

If the fourteenth judgment result is no, executing Step S9320: controlling the spiral material distribution mechanism to reduce the rotating speed.

The third time interval is greater than the second time interval.

Step S9330 to Step S9361 are added to the control method for distributing material of paver in the embodiment on the basis of the embodiments mentioned above. After Step S9310, the height of the material in the material conveying passage is determined through Step S9330 and Step S9340, and then the amount of material conveyed is determined. Through Step S9350, whether the material conveying passage is in a shortage of materials is determined and the nineteenth judgment result is generated. If the nineteenth judgment result is yes, through Step S9351, the prompting device is controlled to output the prompting information corresponding to insufficient material conveying to remind the operator to carry out a feeding operation in time. After the prompting device outputs the prompting information, whether the state of the materials shortage is eliminated is further determined through Step S9360 and a twentieth judgment result is generated. If the twentieth judgment result is yes, it means that the state of the materials shortage in the material conveying passage has not been eliminated. At this time, the traveling mechanism of the paver is directly controlled to stop travelling through Step S9361, so that the paver suspends the paving operation to prevent construction quality from being affected by the operation in the state of materials shortage.

It should be noted that the second height threshold, the second time interval and the third time interval may be set according to a specific model of the material distribution chute, the spiral material distribution mechanism and the traveling speed of the paver. The second time interval is less than the third time interval, the second time interval may range from 2 s to 5 s and the third time interval may range from 5 s to 10 s.

The technical solutions according to some embodiments of the present application are described in detail above in combination with the accompanying drawings. Different states of the materials in the material distribution chute may be determined according to the image information at the material distribution chute and then the spiral material distribution mechanism may be controlled to perform corresponding operations, which may effectively improve the accuracy of the material distribution operation, reduce invalid operations and misoperations, make the distribution of the materials in the material distribution chute more uniform and improve the paving quality of the paver. In addition, in case of abnormal distribution of the materials in the material distribution chute, no manual operation is required to adjust, which saves the time of an adjustment operation and improves the efficiency of material distribution operation.

In this specification, it may be understood that any process or method description in the flowchart or otherwise described herein may be understood as a module, fragment or part of code representing executable instructions including one or more steps for realizing a particular logical function or process, and the scope of the preferred embodiments of this specification includes other implementations, which may not be in the order shown or discussed. The performing functions in a basically simultaneous manner or in a reverse order are included according to the functions involved, which should be understood by those skilled in the art to which the embodiments of this specification belong.

The logic and/or steps represented in the flowchart or otherwise described herein, for example, may be considered as a sequenced list of executable instructions for implementing logical functions and may be embodied in any computer-readable medium for instruction execution systems, apparatus or devices (such as a computer-based system, a system including a processor or other system that may take instructions from an instruction execution system, apparatus, or devices and execute instructions), or is used in combination with these instruction execution systems, apparatus or devices. For this specification, "computer-readable medium" may be any device that may contain, store, communicate, propagate or transmit programs for these instruction execution systems, apparatus or devices to use or to be combined. More specific examples of the computer-readable medium (non exhaustive list) include the following: an electrical connection section (electronic device) with one or more wiring, a portable computer case (magnetic device), a random access memory (RAM), a read only memory (ROM), an electrically programmable read-only-memory (EPROM or Flash memory), an optical fiber device and a compact disc read only memory (CDROM). In addition, the computer-readable medium may even be paper or other suitable medium on which a program may be printed, because the program may be obtained electronically, for example, by optical scanning of the paper or other medium, followed by editing, interpretation or other suitable processing if necessary, and then stored in the computer memory.

Parts of the embodiments according to the present application may be implemented in hardware, software, firmware or a combination thereof. In the above described embodiments, the plurality of steps or methods may be implemented with software or firmware stored in a memory and executed by a suitable instruction execution system. For example, if it is implemented in hardware, as in another embodiment, it may be implemented by any of the following technologies known in the art or a combination of them: a discrete logic circuit with a logic gate circuit for realizing logic functions on data signals, an application specific integrated circuit with a suitable combined logic gate circuit, a programmable gate array (PGA), a field programmable gate array (FPGA), etc.

Those skilled in the art may understand that all or part of the steps carried by the method for realizing the above embodiments may be completed by instructing the relevant hardware through a program and the program may be stored in a computer-readable storage medium. When the program is executed, it includes one or a combination of the steps of the method embodiments.

In addition, each functional unit in each embodiment according to the present application may be integrated in one processing module or exists separately or two or more units may be integrated in one module. The above integrated modules may be implemented in the form of both hardware and software function modules. If the integrated modules are implemented in the form of software function modules and sold or used as independent products, they may also be stored in a computer-readable storage medium.

The storage medium mentioned above may be a read-only memory, a magnetic disk or an optical disk.

The above are only the implementation manners of the present application and the description is relatively specific and detailed, but it should not be understood as a limitation to the scope of the present application. For those skilled in the art, the technical solution of the present application may have various changes and transformation. It should be pointed out that for those of ordinary skill in the art, without departing from the concept of the present application, several modifications and improvements may be made, and these all fall within the protection scope of this application.

What is claimed is:

1. A paver control system, applied to a paver, comprising an image acquisition device, a controller and an execution device;

wherein:

the image acquisition device is provided on the paver for acquiring image information of the execution device;

the controller is provided on the paver and electrically connected with the image acquisition device and the execution device for determining a relative position between a feeding car of the paver and a hopper of the paver according to the image information acquired by the image acquisition device and controlling the execution device to operate; and the execution device is provided on the paver for operating under a control of the controller;

wherein the execution device comprises a driving mechanism, and a driving end of the driving mechanism is connected with the hopper for driving the hopper to spread or close.

2. The paver control system according to claim 1, wherein the paver control system comprises a control system for the hopper of the paver;

wherein:

the image acquisition device is used to acquire image information of the hopper, a material conveying mechanism and the feeding car of the paver;

the controller is electrically connected with the image acquisition device and the driving mechanism to control the driving mechanism to operate according to the image information acquired by the image acquisition device; and the material conveying mechanism is provided on the hopper for receiving materials of the feeding car in an unfolded state and discharging the materials into the material conveying mechanism in a closed state.

3. The paver control system according to claim 2, wherein the image acquisition device comprises:

a camera, provided on the paver and above the hopper for acquiring the image information; and a memory, electrically connected with the camera and the controller for storing the image information acquired by the camera and sending the image information and reference image information to the controller;

wherein the reference image information is stored in the memory for recording image positions of the hopper in the unfolded state and the closed state, an image position of the material conveying mechanism and image positions of a tail outline of the feeding car when an area of which is at a first area threshold and a second area threshold, and the controller determines the relative position between the feeding car and the hopper by comparing the image position in the image information and the reference image information and controls the driving mechanism to operate.

4. The paver control system according to claim 3, further comprising:

a lighting device, provided on the paver for providing lighting for an image acquisition area of the camera.

5. The paver control system according to claim 2, further comprising:

a prompting device, provided on the paver and/or the feeding car for outputting prompting information, wherein the controller is electrically connected with the prompting device to control the prompting device to output the prompting information according to the image information.

6. The paver control system according to claim 1, wherein the paver control system comprises a guide system for feeding car of paver and the execution device comprises a prompting device;

wherein:

the image acquisition device is used to acquire the image information of the hopper of the paver and the feeding car;

the prompting device is provided on the feeding car for outputting prompting information of guidance corresponding to an operation process of the feeding car; and the controller is electrically connected with the image acquisition device and the prompting device to control the prompting device to operate according to the image information acquired by the image acquisition device.

7. The paver control system according to claim 6, wherein the image acquisition device comprises:

a camera, provided on the paver and above the hopper for acquiring the image information; and a memory, electrically connected with the camera and the controller for storing the image information acquired by the camera and sending the image information and reference image information to the controller;

wherein the reference image information is stored in the memory for recording images of tail outlines of the feeding car, outlines of a feeding bin, outlines of materials and outlines of the hopper in different states and the controller determines the relative position between the feeding car and the hopper or a material state in the feeding bin by comparing the image information and the reference image information and controls the prompting device to output corresponding prompting information for guidance.

8. The paver control system according to claim 7, further comprising:

a pressure detector, provided on a material conveying mechanism of the paver for detecting a conveying pressure of the material conveying mechanism, wherein the controller is electrically connected with the pressure detector to control the prompting device to output the prompting information for guidance corresponding to the conveying pressure according to the conveying pressure.

9. The paver control system according to claim 7, wherein the image acquisition device comprises:

a lighting device, provided on the paver for providing lighting for an image acquisition area of the camera.

10. The paver control system according to claim 1, wherein the paver control system comprises a material distribution system for paver, the execution device comprises a material distribution device, and the material distribution device comprises a material distribution chute and a spiral material distribution mechanism;

wherein:

the material distribution chute, provided on the paver and provided along a width direction of the paver, is connected with a material conveying passage of the paver and provided with an opening at the bottom of the material distribution chute to discharge the materials conveyed from the material conveying passage to the material distribution chute into a pavement to be paved through the opening;

the spiral material distribution mechanism, provided in the material distribution chute and provided along the width direction of the paver, drives materials in the material distribution chute to move along the width direction of the paver by a rotation of the spiral material distribution mechanism to realize a material distribution;

the image acquisition device is used to acquire the image information at the material distribution chute; and the controller is electrically connected with the image acquisition device and the spiral material distribution mechanism to control an operating state of the spiral material distribution mechanism according to the image information, so as to perform a material distribution operation on the materials in the material distribution chute.

11. The paver control system according to claim 10, wherein the image acquisition device comprises:

a camera, provided on the paver and above the material distribution chute for acquiring the image information; and a memory, provided on the paver and electrically connected with the camera and the controller for storing the image information acquired by the camera and sending the image information and reference image information to the controller;

wherein the reference image information is stored in the memory for recording image positions of the materials in the material distribution chute at different heights and the controller determines a state of the materials in the material distribution chute by comparing the image position of the material in the image information and the image position of the material in the reference image information and controls the spiral material distribution mechanism to perform corresponding operations.

12. The paver control system according to claim 11, further comprising:

a first detector, provided in the material conveying passage of the paver for detecting a height of materials in the material conveying passage; and a prompting device, provided on the paver for outputting prompting information;

wherein the controller is electrically connected with the first detector and the prompting device to control the prompting device to output corresponding prompting information according to the height of the materials in the material conveying passage.

13. A paver, comprising:

a paver body; and the paver control system according to claim 1, wherein the image acquisition device and the controller are provided on the paver body and the controller controls the execution device to operate according to the image information.

14. A paver control method, applied to the paver control system according to claim 1, wherein the paver control method comprises:

acquiring image information of an execution device of a paver for determining a relative position between a feeding car of the paver and a hopper of the paver according to the image information; and controlling the execution device to operate according to the image information.

15. The paver control method according to claim 14, wherein the paver control method comprises a control method for the hopper of the paver and the acquiring the image information of the execution device of the paver comprises:

acquiring image information of the hopper, a material conveying mechanism and the feeding car of the paver;

wherein the controlling the execution device to operate according to the image information comprises:

controlling a driving mechanism to drive the hopper to spread or close according to the relative position between the feeding car and the hopper in the image information;

wherein the material conveying mechanism is provided on the hopper and the hopper is used to receive materials of the feeding car in an unfolded state and discharge the materials to the material conveying mechanism in a closed state.

16. The paver control method according to claim 15, wherein the controlling the driving mechanism to drive the hopper to spread or close according to the relative position between the feeding car and the hopper in the image information comprises:

determining a changing process of a tail outline of the feeding car in the image information;

controlling, if the tail outline of the feeding car in the image information enters a first area, the driving mechanism to operate to drive the hopper to spread; and continuously acquiring the image information;

controlling, if the tail outline of the feeding car in the image information enters a second area from the first area, the driving mechanism to enter a locking state.

17. The paver control method according to claim 14, wherein the paver control method comprises a guide method for feeding car of paver and the acquiring image information of the execution device of the paver comprises:

acquiring the image information of the hopper and the feeding car of the paver;

wherein the controlling the execution device to operate according to the image information comprises:

controlling a prompting device to output prompting information for guidance corresponding to an operation process of the feeding car according to the image information.

18. The paver control method according to claim 17, wherein the controlling a prompting device to output prompting information for guidance corresponding to an operation process of the feeding car according to the image information comprises:

determining a changing process of a tail outline of the feeding car in the image information;

if an area of the tail outline of the feeding car is greater than a first area threshold, an edge line of the tail outline of the feeding car is within an area surrounded by an outline of the hopper, and an included angle between a longitudinal edge of the feeding bin of the feeding car and a transverse edge of the front end of the hopper is within a first angle range, controlling the prompting device to output prompting information for guidance and guiding the feeding car to reverse in a straight line to approach the hopper;

if an area of the tail outline of the feeding car is greater than a first area threshold, an edge line of the tail outline of the feeding car is within an area surrounded by an outline of the hopper, and an included angle between a longitudinal edge of the feeding bin of the feeding car and a transverse edge of the front end of the hopper is not within a first angle range, controlling the prompting device to output prompting information for guidance, guiding the feeding car to turn and reverse to approach the hopper and making the included angle fall within the first angle range; and if an area of the tail outline of the feeding car is greater than a first area threshold, and an edge line of the tail outline of the feeding car is not within an area surrounded by an outline of the hopper, controlling the prompting device to output prompting information for guidance and guiding the feeding car to adjust an orientation.

19. The paver control method according to claim 14, wherein the paver control method comprises a control method for distributing material of paver and the acquiring image information of the execution device of the paver comprises:

acquiring image information at a material distribution chute of the paver;

wherein the controlling the execution device to operate according to the image information comprises:

controlling a spiral material distribution mechanism of the paver to operate according to the image information to perform a material distribution operation on the materials in the material distribution chute.

20. The paver control method according to claim 19, wherein the controlling a spiral material distribution mechanism of the paver to operate according to the image information to perform a material distribution operation on the materials in the material distribution chute comprises:

determining an image position of a top edge line of the materials in the material distribution chute according to the image information;

performing an averaging process on the image position to determine an average height of the top edge line of the materials;

controlling, if the average height is lower than a first height threshold, the spiral material distribution mechanism to increase a rotating speed; and controlling, if the average height is greater than a first height threshold, the spiral material distribution mechanism to reduce the rotating speed.

* * * * *